US012075901B1

(12) United States Patent
Fuller et al.

(10) Patent No.: US 12,075,901 B1
(45) **Date of Patent: *Sep. 3, 2024**

(54) MATERIAL APPLICATOR

(71) Applicant: Go Products Co., North St. Paul, MN (US)

(72) Inventors: Kevin S. Fuller, Chaska, MN (US); Wayde J. Altendorf, Hickson, ND (US)

(73) Assignee: Go Products Co., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/862,975

(22) Filed: Jul. 12, 2022

Related U.S. Application Data

(63) Continuation of application No. 17/217,787, filed on Mar. 30, 2021, now Pat. No. 11,382,400, which is a (Continued)

(51) Int. Cl.

| | |
|---|---|
| ***B43K 21/08*** | (2006.01) |
| ***A45D 40/06*** | (2006.01) |
| *A45D 40/00* | (2006.01) |

(52) U.S. Cl.
CPC ..... *A45D 40/06* (2013.01); *A45D 40/065* (2013.01); *A45D 2040/0025* (2013.01)

(58) Field of Classification Search
CPC ..... A45D 40/04; A45D 40/06; A45D 40/065; A45D 2040/0025

(Continued)

(56) References Cited

U.S. PATENT DOCUMENTS

| | | | |
|---|---|---|---|
| D19,417 | S | 11/1889 | Estes |
| 917,804 | A | 4/1909 | Sedgwick |

(Continued)

FOREIGN PATENT DOCUMENTS

| | | | |
|---|---|---|---|
| AU | 749634 | B2 | 6/2002 |
| CA | 2191852 | C | 11/2002 |
| CA | 2510072 | C | 12/2008 |
| CN | 303923883 | | 11/2016 |
| CN | 304296141 | | 9/2017 |

(Continued)

OTHER PUBLICATIONS

Lip Balm, GoLiips, thinkdg.com, date and author not listed © 2018 ThinkDesign Group, online, site visited Feb. 1, 2019. Available from Internet, URL: http://www.thinkdg.com/portfolio/gollips/ (Year: 2018).

(Continued)

*Primary Examiner* — Jennifer C Chiang
(74) *Attorney, Agent, or Firm* — Christensen, Fonder, Dardi & Herbert PLLC; Douglas J. Christensen

(57) ABSTRACT

A dispenser, such as for lip balm, has a casing, a manually operable dispense mechanism with an actuation dial, lip balm in the casing, and a cap for covering a dispense end. The dispense mechanism included a snap-in actuator that interfaces with cantilevered fingers unitary with the casing. Finger tips interface the actuator at a retention flange for rotatably retaining the actuator within the casing, the finger tips further interface with circumferentially spaced ribs or nubs rearward of the flange for providing a user perceivable tactile clicking and/or a variable rotation resistance upon rotation of the dial. The casing having an enlarged dispense end, a narrowed lower waist region, an exterior surface (Continued)

include an overmolded softened high friction gripping surface on the casing. The exterior surface may include light transmissive portions defining indicia that extend into the casing interior.

21 Claims, 26 Drawing Sheets

Related U.S. Application Data continuation of application No. 16/538,778, filed on Aug. 12, 2019, now abandoned.

(60) Provisional application No. 62/717,651, filed on Aug. 10, 2018.

(58) Field of Classification Search
USPC ..... 401/75, 78, 174, 175
See application file for complete search history.

(56) References Cited

U.S. PATENT DOCUMENTS 1,338,156 A 4/1920 Purple
1,852,455 A 4/1932 Friedman
1,969,027 A 8/1934 Morrison
D98,444 S 2/1936 McManus
2,079,131 A 5/1937 Reichenbach et al.
2,131,975 A 10/1938 Samstag
2,143,061 A 1/1939 Eastley
2,147,263 A 2/1939 Mills
2,171,112 A 8/1939 Hoffman
2,201,467 A 5/1940 Bloom
2,222,415 A 11/1940 Landwehr
2,226,409 A 12/1940 Patterson et al.
2,304,681 A 12/1942 Eckart
2,314,338 A 3/1943 Graves et al.
2,337,682 A 12/1943 Reichenbach
2,367,992 A 1/1945 Berls
2,387,639 A 10/1945 Bouchelle
2,485,467 A 10/1949 Weisbaum
2,511,557 A 6/1950 Arnold
2,568,688 A 9/1951 Shatkin
2,630,216 A 3/1953 Isele
2,728,494 A 12/1955 Hobson
2,816,309 A 12/1957 Worth et al.
2,816,654 A 12/1957 Fuller et al.
2,917,765 A 12/1959 Jakubowski
2,935,191 A 5/1960 Leshin
2,980,246 A 4/1961 Leshin
3,023,925 A 3/1962 Sher
D193,311 S 7/1962 Buckley
3,156,279 A 11/1964 Grebowiec et al.
3,179,246 A 4/1965 Rosenburg, Jr.
3,185,345 A 5/1965 Hunegs
3,191,768 A 6/1965 Davis
3,226,762 A 1/1966 Norman
3,298,516 A 1/1967 Leopold
3,311,248 A 3/1967 Marchant
3,333,740 A 8/1967 Waller
3,370,733 A 2/1968 Giesler
3,420,417 A 1/1969 Kardel
D214,553 S 7/1969 Plummer
3,482,920 A 12/1969 Schwartzman
3,527,342 A 9/1970 Manzo
3,540,583 A 11/1970 Tomlinson
3,616,970 A 11/1971 Baumann et al.
3,620,632 A 11/1971 Gruska
3,672,543 A 6/1972 Roper et al.
3,698,551 A 10/1972 Tomlinson
3,738,538 A 6/1973 Roper et al.
3,756,730 A 9/1973 Spatz
3,850,183 A 11/1974 Gruska
3,871,543 A 3/1975 Chadfield et al.
3,885,373 A 5/1975 Place et al.
3,891,090 A 6/1975 Spiegel et al.
3,908,826 A 9/1975 Faller
3,908,827 A 9/1975 Bemmels et al.
3,917,417 A 11/1975 Lang
D240,113 S 6/1976 Conrad
4,002,003 A 1/1977 Place et al.
D243,830 S 3/1977 Jones et al.
D244,509 S 5/1977 Jones et al.
4,044,889 A 8/1977 Orentreich et al.
4,124,135 A 11/1978 Weder et al.
4,139,127 A 2/1979 Gentile
4,164,301 A 8/1979 Thayer
4,235,557 A 11/1980 Hayes
D261,863 S 11/1981 Pardo
4,298,036 A 11/1981 Horvath
4,323,176 A 4/1982 Sartain
4,331,237 A 5/1982 Edell
4,342,522 A 8/1982 Mackles
4,363,560 A 12/1982 Gentile
D267,629 S 1/1983 Hasegawa et al.
4,369,158 A 1/1983 Woodruff et al.
D269,763 S 7/1983 Fortuna
D269,764 S 7/1983 Fortuna
4,485,699 A 12/1984 Fuller
4,506,810 A 3/1985 Goncalves
4,508,225 A 4/1985 Ferrari
4,521,127 A 6/1985 Tomburo et al.
4,545,696 A 10/1985 Carluccio
D281,304 S 11/1985 Fortuna
4,552,161 A 11/1985 Hill et al.
D281,673 S 12/1985 Lampe
4,564,130 A 1/1986 Eulenburg
4,580,920 A 4/1986 Schmidt
4,595,124 A 6/1986 Duval et al.
4,605,330 A 8/1986 Crowley et al.
4,621,935 A 11/1986 Sussman
4,658,993 A 4/1987 Vlasich
4,664,547 A 5/1987 Rosenwinkel
4,700,448 A 10/1987 Parker
4,702,399 A 10/1987 Davis
4,728,210 A 3/1988 Barish et al.
4,753,373 A 6/1988 Seager
4,779,770 A 10/1988 Herold
4,781,483 A 11/1988 Lorscheidt
4,784,268 A 11/1988 Perchak
4,884,912 A 12/1989 Gueret
4,890,944 A 1/1990 Cousins et al.
4,915,528 A 4/1990 Seager
4,932,803 A 6/1990 Goldberger et al.
4,950,094 A 8/1990 Yorks
4,958,731 A 9/1990 Calcerano
D311,260 S 10/1990 Hasert
4,984,718 A 1/1991 Cardia
5,000,356 A 3/1991 Johnson et al.
5,000,600 A 3/1991 Cardia et al.
5,007,755 A 4/1991 Thompson
5,016,782 A 5/1991 Pfanstiel
5,025,817 A 6/1991 Wen
5,025,960 A 6/1991 Seager
5,044,496 A 9/1991 Tanaka et al.
5,061,102 A 10/1991 Rennie
5,085,352 A 2/1992 Sasaki et al.
5,099,998 A 3/1992 Curzon et al.
5,111,972 A 5/1992 Sakurai et al.
5,118,009 A 6/1992 Novitsky
D328,248 S 7/1992 Ruff
5,137,185 A 8/1992 Mitchell
5,137,387 A 8/1992 Byrd et al.
5,167,462 A 12/1992 Lucas
D332,750 S 1/1993 Moloney et al.
5,186,561 A 2/1993 Ackermann et al.
5,230,577 A 7/1993 Cox et al.
5,234,136 A 8/1993 Kopis
5,320,259 A 6/1994 Weinstein
5,324,126 A 6/1994 Holloway et al.
D349,176 S 7/1994 Litton
5,326,185 A 7/1994 Dornbusch et al.
5,340,225 A 8/1994 Chevassus
5,372,285 A 12/1994 Harrold et al.

(56) References Cited

U.S. PATENT DOCUMENTS 5,381,912 A 1/1995 Walker et al.
5,401,112 A 3/1995 Dornbusch et al.
D359,910 S 7/1995 Hirsch
5,437,513 A 8/1995 Favre
5,496,122 A 3/1996 Fattori
5,503,825 A 4/1996 Lane
5,540,361 A 7/1996 Fattori
5,547,302 A 8/1996 Dornbusch et al.
D375,256 S 11/1996 Chadfield
5,573,341 A 11/1996 Iaia
D377,543 S 1/1997 Hanson
5,697,531 A 12/1997 Fattori
D393,106 S 3/1998 Rokitta et al.
5,725,133 A 3/1998 Iaia
5,727,891 A 3/1998 Lang
5,733,058 A 3/1998 Hofmann
5,733,617 A 3/1998 Baduel
5,738,123 A 4/1998 Szekely
5,753,212 A 5/1998 Pescatore et al.
5,772,347 A 6/1998 Gueret
5,779,109 A 7/1998 Gueret
5,797,692 A 8/1998 Poole et al.
5,799,667 A 9/1998 Szekely
5,800,086 A 9/1998 Piscopo et al.
D399,605 S 10/1998 Metcalf
5,839,622 A 11/1998 Bicknell et al.
5,842,805 A 12/1998 Pierpont
5,851,079 A 12/1998 Horstman et al.
5,860,572 A 1/1999 Harrold et al.
D405,358 S 2/1999 Dapsanse
5,868,510 A 2/1999 Lacout et al.
5,873,495 A 2/1999 Saint-Germain
5,879,096 A 3/1999 Franta et al.
5,881,920 A 3/1999 Seager et al.
5,881,921 A 3/1999 Seager et al.
5,884,759 A 3/1999 Gueret
5,888,004 A 3/1999 Bouix
D407,854 S 4/1999 DeGaetano
D417,932 S 4/1999 Siegel et al.
5,897,539 A 4/1999 Elliesen et al.
5,899,333 A 5/1999 Williams et al.
5,922,349 A 7/1999 Elliesen et al.
5,947,621 A 9/1999 Szekely
5,950,880 A 9/1999 Garcia
5,961,005 A 10/1999 Pichonnier et al.
5,964,226 A 10/1999 Sobel
5,967,683 A 10/1999 Fattori
5,979,708 A 11/1999 Seager et al.
5,988,917 A 11/1999 Sheffler et al.
D419,442 S 1/2000 McClung et al.
D420,466 S 2/2000 Coates et al.
D420,766 S 2/2000 Coates et al.
6,039,483 A 3/2000 Szekely
D423,723 S 4/2000 Metcalf
6,048,122 A 4/2000 Ohba
6,050,415 A 4/2000 Lind et al.
6,082,372 A 7/2000 Mizukaki
6,083,528 A 7/2000 Elliesen et al.
6,105,823 A 8/2000 Seager et al.
6,116,803 A 9/2000 Szekely et al.
D431,683 S 10/2000 Hillock
6,129,471 A 10/2000 Lang
6,129,472 A 10/2000 Thayer
6,139,208 A 10/2000 Monin-Bareil
D433,562 S 11/2000 Redlinger
D433,876 S 11/2000 Freed
6,155,734 A 12/2000 Kageyama et al.
6,155,735 A 12/2000 Nakajima
6,190,074 B1 2/2001 Demellier et al.
6,193,427 B1 2/2001 Bnguigui
6,200,048 B1 3/2001 Bouix
6,227,739 B1 5/2001 Kageyama
6,231,255 B1 5/2001 Tsai
6,234,698 B1 5/2001 De Laforcade
D443,951 S 6/2001 Look
D444,040 S 6/2001 Yip
D444,264 S 6/2001 Look
D444,265 S 6/2001 Look
6,241,408 B1 6/2001 Lang
D444,593 S 7/2001 Look
D444,597 S 7/2001 Weinstock
D444,913 S 7/2001 Look
D444,917 S 7/2001 Weinstock
D446,355 S 8/2001 Weinstock
D446,356 S 8/2001 Look
D446,606 S 8/2001 Look
D446,607 S 8/2001 Look
6,269,982 B1 8/2001 Kreiseder et al.
6,276,857 B1 8/2001 Szekely
D448,120 S 9/2001 Look
6,283,658 B1 9/2001 Estevez et al.
6,293,719 B1 9/2001 Ohba
6,299,369 B1 10/2001 Baines et al.
6,305,385 B1 10/2001 Szekely
6,315,171 B1 11/2001 Piscopo et al.
D452,585 S 12/2001 Look
D452,586 S 12/2001 Look
D452,587 S 12/2001 Look
D452,588 S 12/2001 Look
6,186,686 B1 12/2001 Neuner et al.
D452,753 S 1/2002 Look
6,336,763 B1 1/2002 Losier et al.
D453,973 S 2/2002 Look
D453,974 S 2/2002 Look
6,345,922 B2 2/2002 Tani
D454,227 S 3/2002 Look
D454,228 S 3/2002 Look
D454,229 S 3/2002 Look
D454,282 S 3/2002 Mano
D454,414 S 3/2002 Look
D454,661 S 3/2002 Look
D454,662 S 3/2002 Look
D454,663 S 3/2002 Look
D454,664 S 3/2002 Look
D454,665 S 3/2002 Look
D454,666 S 3/2002 Look
D454,983 S 3/2002 Look
D454,984 S 3/2002 Look
D454,985 S 3/2002 Look
6,357,945 B1 3/2002 Losier et al.
D455,233 S 4/2002 Look
D455,234 S 4/2002 Look
D455,868 S 4/2002 Look
D456,099 S 4/2002 Look
6,364,115 B1 4/2002 Casanova et al.
D456,953 S 5/2002 Look
6,391,972 B1 5/2002 Hatakeyama
6,398,439 B1 6/2002 Szekely
6,412,999 B1 7/2002 Pierpont
6,419,412 B1 7/2002 Ostrowski et al.
D461,352 S 8/2002 Pianezza
6,435,748 B1 8/2002 Taghikhani
6,447,191 B1 9/2002 Vasas
6,450,179 B2 9/2002 Bengis
6,450,716 B1 9/2002 Szekely
6,450,722 B1 9/2002 Ruschke et al.
6,497,523 B1 12/2002 Kuroiwa et al.
6,551,611 B2 4/2003 Elliesen et al.
6,561,711 B1 5/2003 Pierpont
6,571,992 B2 6/2003 Pierson et al.
6,572,300 B2 6/2003 Altonen et al.
6,592,278 B1 7/2003 Holthaus
6,598,767 B2 7/2003 Baines et al.
6,616,363 B1 9/2003 Guillaume et al.
D481,574 S 11/2003 Snell
6,648,538 B2 11/2003 Gueret
6,655,557 B2 12/2003 Rousselet et al.
6,688,317 B2 2/2004 Gueret
6,688,793 B2 2/2004 Goyet
6,723,269 B2 4/2004 Grosz et al.
6,732,743 B1 5/2004 Bouix et al.
6,736,267 B2 5/2004 Schamante
6,745,781 B2 6/2004 Gueret
D492,592 S 7/2004 Palomino, Jr.

(56) References Cited

U.S. PATENT DOCUMENTS

D493,053 S 7/2004 Snell
6,773,187 B2 8/2004 Gueret
6,776,981 B2 8/2004 Elliott et al.
D496,135 S 9/2004 Hillock
6,793,431 B1 9/2004 Tsai
D497,778 S 11/2004 Rich
6,820,776 B2 11/2004 Hemming et al.
D499,552 S 12/2004 Nissanoff et al.
6,827,213 B2 12/2004 Hirotomi et al.
6,827,516 B2 12/2004 Gutberlet
6,835,016 B2 12/2004 Noguchi
6,838,032 B2 1/2005 Grosz et al.
6,890,119 B2 5/2005 Ruschke et al.
6,899,484 B2 5/2005 Ohba
D505,831 S 6/2005 Liu
6,905,272 B2 6/2005 Yamanaka
6,918,511 B1 7/2005 Spatz et al.
6,939,070 B2 9/2005 Butz et al.
6,981,811 B2 1/2006 Breidenbach et al.
6,983,864 B1 1/2006 Cagle
D515,429 S 2/2006 Pace
7,044,667 B2 5/2006 Tanaka et al.
D522,696 S 6/2006 Severa
D522,880 S 6/2006 Fuller et al.
7,073,966 B2 7/2006 Murakoshi
D526,775 S 8/2006 Anderton
7,086,564 B1 8/2006 Corrigan
D528,290 S 9/2006 Anderton
D530,572 S 10/2006 Daams
D531,056 S 10/2006 Ioannides et al.
7,128,486 B2 10/2006 Ohba et al.
D534,082 S 12/2006 Chadfield
7,144,171 B2 12/2006 Blondeel et al.
D536,220 S 2/2007 Sandberg
D536,263 S 2/2007 Ioannides et al.
D536,264 S 2/2007 Ioannides et al.
D536,582 S 2/2007 Roth et al.
D538,477 S 3/2007 Kaplan
D541,479 S 4/2007 Cronin et al.
7,201,526 B2 4/2007 Tani
7,213,994 B2 5/2007 Phipps et al.
7,249,692 B2 7/2007 Walters et al.
7,264,141 B2 9/2007 Patel et al.
7,284,926 B2 10/2007 Tanaka et al.
D554,529 S 11/2007 Green et al.
7,303,348 B2 12/2007 Phipps et al.
7,325,707 B2 2/2008 Bougamont et al.
D563,096 S 3/2008 Ivey
7,354,215 B2 4/2008 Rego et al.
D570,688 S 6/2008 Haywood
7,381,003 B1 6/2008 Chang
7,389,894 B2 6/2008 Danne et al.
7,435,028 B2 10/2008 Cummings et al.
7,455,467 B2 11/2008 Sasaki
7,467,731 B2 12/2008 Shraiber
7,475,436 B2 1/2009 Heukamp
D587,071 S 2/2009 Roth et al.
7,500,799 B2 3/2009 Holloway
D592,909 S 5/2009 Alviar et al.
D593,414 S 6/2009 Hunter
D593,713 S 6/2009 Fogelson
7,621,405 B2 11/2009 Schweitzer et al.
D605,364 S 12/2009 Lokken
7,631,781 B2 12/2009 Chen
D609,107 S 2/2010 Dubitsky et al.
7,654,420 B2 2/2010 Honda et al.
7,677,828 B2 3/2010 Tani
7,686,192 B1 3/2010 Patton et al.
7,694,856 B2 4/2010 Rossignol
7,695,727 B2 4/2010 Magee et al.
7,699,062 B2 4/2010 Sasaki
D618,397 S 6/2010 Dubitsky et al.
D618,398 S 6/2010 Dubitsky et al.
7,726,480 B2 6/2010 Nazari
7,736,079 B2 6/2010 Tani
D620,377 S 7/2010 Diss
7,748,892 B2 7/2010 McCoy
7,789,582 B2 9/2010 Babel et al.
D625,469 S 10/2010 Dubitsky et al.
7,845,874 B2 12/2010 Crosnier et al.
D631,204 S 1/2011 Dubitsky et al.
7,878,728 B2 2/2011 Nasu et al.
7,891,896 B2 2/2011 Nasu
D634,072 S 3/2011 Tsai
D634,073 S 3/2011 Tsai
D634,074 S 3/2011 Tsai
D634,075 S 3/2011 Tsai
D634,076 S 3/2011 Tsai
7,909,527 B2 3/2011 King
7,938,591 B2 5/2011 Kokai
7,946,780 B2 5/2011 Zhang
D639,166 S 6/2011 Carreno
D641,591 S 7/2011 Tsukida
D644,939 S 9/2011 Teller
8,011,847 B2 9/2011 Tani
D648,488 S 11/2011 Tsai
D648,599 S 11/2011 Watanabe et al.
8,079,499 B2 12/2011 Juteau et al.
8,104,984 B2 1/2012 Tani
8,132,977 B2 3/2012 Pires et al.
8,157,114 B2 4/2012 Baylous et al.
8,172,472 B2 5/2012 Tani
D661,431 S 6/2012 Bagley
8,205,747 B2 6/2012 Nazari
8,215,861 B2 7/2012 Gueret
8,225,955 B2 7/2012 Moskow et al.
8,235,257 B2 8/2012 Avairis
8,267,606 B2 9/2012 Delbove et al.
8,292,529 B2 10/2012 Francavilla
8,292,532 B2 10/2012 Nasu et al.
8,297,867 B2 10/2012 Nasu et al.
D671,010 S 11/2012 Shefler
8,328,447 B2 12/2012 Tani
D675,881 S 2/2013 Wamack, Jr.
8,388,249 B2 3/2013 Groh et al.
D681,278 S 4/2013 Schlatter
8,407,879 B1 4/2013 Glaspell
8,414,209 B2 4/2013 Forrey
D682,058 S 5/2013 Puglisi et al.
D682,625 S 5/2013 Lane
D683,238 S 5/2013 You
8,444,337 B2 5/2013 Teller
8,469,621 B2 6/2013 Zukowski et al.
8,511,922 B2 8/2013 Prischak
8,534,946 B2 9/2013 Cont
8,540,124 B2 9/2013 Francavilla
D690,610 S 10/2013 Maxwell-Wood
8,544,684 B2 10/2013 Perez
8,550,738 B2 10/2013 Thorpe et al.
8,562,232 B2 10/2013 Ishida
8,579,533 B2 11/2013 Sasada et al.
8,591,129 B2 11/2013 Chan
D697,802 S 1/2014 Lane
D698,089 S 1/2014 Smith
D698,090 S 1/2014 Smith
D698,496 S 1/2014 Smith
D698,497 S 1/2014 Smith et al.
8,657,514 B2 2/2014 Kim
8,672,185 B2 3/2014 Worthington et al.
D703,052 S 4/2014 Park
D703,053 S 4/2014 Park
8,684,184 B2 4/2014 Moskow et al.
8,696,226 B2 4/2014 Hornfeck
8,708,146 B2 4/2014 Falcon
8,727,651 B2 5/2014 Arai et al.
D708,789 S 7/2014 Schlatter
D708,790 S 7/2014 Schlatter
D708,791 S 7/2014 Schlatter
8,777,066 B2 7/2014 Esteve et al.
D712,597 S 9/2014 Albertini
D714,490 S 9/2014 Betts
D717,610 S 11/2014 Lin
8,875,955 B2 11/2014 Arora et al.
8,888,391 B2 11/2014 Teller et al.

(56) References Cited

U.S. PATENT DOCUMENTS 8,899,860 B2 12/2014 Baines et al.
8,905,665 B2 12/2014 Chang
8,950,964 B1 2/2015 Jefferson
8,961,048 B2 2/2015 Baines et al.
D723,331 S 3/2015 Lapsker
9,004,793 B2 4/2015 Huang
9,004,795 B2 4/2015 Salciarini
9,027,786 B2 5/2015 Doyle et al.
D731,251 S 6/2015 Lane
9,067,233 B2 6/2015 Noguchi et al.
D733,565 S 7/2015 Leventhal
D733,967 S 7/2015 Schlatter
D734,550 S 7/2015 Schlatter
D734,894 S 7/2015 Schlatter
D735,414 S 7/2015 Schlatter
9,097,571 B2 8/2015 Phipps et al.
9,101,194 B2 8/2015 Ishida
9,113,693 B2 8/2015 Yan
9,173,530 B2 11/2015 Fallat, II et al.
9,179,755 B2 11/2015 Little et al.
9,185,963 B2 11/2015 Weeston
D745,742 S 12/2015 Betts
9,232,845 B2 1/2016 Drugeon et al.
9,265,327 B2 2/2016 Thulin et al.
9,265,328 B2 2/2016 Braeuer et al.
D750,503 S 3/2016 Ziegler et al.
D752,291 S 3/2016 Schlatter
9,271,555 B1 3/2016 Chen
9,283,060 B2 3/2016 Peuker et al.
D754,223 S 4/2016 Pederson et al.
9,307,822 B2 4/2016 Adams et al.
D756,037 S 5/2016 Schlatter et al.
9,327,891 B2 5/2016 Brandow
9,332,818 B2 5/2016 Holloway
9,339,097 B2 5/2016 Weishaar et al.
9,346,597 B2 5/2016 Bradfield
9,351,556 B2 5/2016 Kim
9,375,069 B2 6/2016 Crawford
9,375,070 B2 6/2016 Tsuhara et al.
9,386,840 B2 7/2016 Huang et al.
D762,476 S 8/2016 Velmer et al.
9,410,837 B2 8/2016 Brugger
9,414,664 B2 8/2016 Irving et al.
9,420,870 B2 8/2016 Lebert
D766,112 S 9/2016 Baker et al.
9,433,275 B2 9/2016 Crawford et al.
9,433,276 B2 9/2016 McNamara et al.
D768,336 S 10/2016 Schlatter et al.
9,474,349 B2 10/2016 Holloway
9,474,350 B2 10/2016 Thompson
9,474,351 B2 10/2016 Chen
D772,481 S 11/2016 Paquet
D772,784 S 11/2016 Higgins
D775,426 S 12/2016 Huff
9,510,660 B2 12/2016 Ishida
D776,354 S 1/2017 Schlatter et al.
D777,985 S 1/2017 Schlatter et al.
9,549,603 B2 1/2017 Ohba et al.
9,554,636 B1 1/2017 Piscopo
D778,502 S 2/2017 Teller
D778,503 S 2/2017 Teller
D779,737 S 2/2017 Salmon
9,585,458 B2 3/2017 Teller et al.
9,585,460 B2 * 3/2017 Wade ..... A45D 40/06
9,603,434 B2 3/2017 Zhu et al.
9,630,765 B1 4/2017 Nelson
D787,741 S 5/2017 Paquet
9,642,439 B2 5/2017 Holloway
9,668,563 B2 6/2017 Shorland et al.
9,723,907 B2 8/2017 Huang et al.
9,730,505 B2 8/2017 Jouan et al.
9,775,422 B2 10/2017 Ishida
9,788,635 B2 10/2017 Tani
9,795,205 B2 10/2017 Bolander et al.
9,809,052 B2 11/2017 Heipp
9,814,294 B2 11/2017 Hermouet et al.
9,820,549 B2 11/2017 Liard
9,820,550 B2 11/2017 Heraud
9,820,551 B2 11/2017 Ellsworth et al.
9,826,814 B2 11/2017 Baudin et al.
9,826,816 B1 11/2017 Chang
9,844,254 B2 12/2017 Kim
9,872,551 B2 1/2018 Swaile et al.
9,877,566 B2 1/2018 Liard
9,883,728 B2 2/2018 Naramoto
9,888,760 B2 2/2018 Naramoto
9,908,140 B2 3/2018 Arwatz et al.
D815,532 S 4/2018 Zhou
9,930,953 B2 4/2018 Liard et al.
9,986,811 B2 6/2018 Yang
10,004,317 B2 6/2018 Keller et al.
10,028,566 B2 7/2018 Zelbst et al.
D830,855 S 10/2018 Cox
D835,520 S 12/2018 Peeters
10,150,126 B2 12/2018 Lee
10,196,196 B2 2/2019 Philipp
10,278,477 B2 5/2019 Teller et al.
10,308,418 B1 * 6/2019 Dakolios ..... B05C 17/0116
10,506,863 B2 * 12/2019 Bartlett ..... A45D 40/04
10,517,373 B2 * 12/2019 Ellsworth ..... B65D 83/0011
10,687,602 B2 * 6/2020 Thulin ..... A45D 40/04
2002/0067949 A1 6/2002 Melnik et al.
2002/0179655 A1 12/2002 Finlay
2003/0080018 A1 5/2003 Nally
2003/0108376 A1 6/2003 Hurlburt
2003/0143015 A1 7/2003 Bouzaglo
2004/0156667 A1 8/2004 Berger et al.
2005/0072801 A1 4/2005 Chadfield et al.
2005/0103807 A1 5/2005 Murphy
2005/0105955 A1 5/2005 Petit et al.
2005/0129455 A1 6/2005 Avalle
2005/0133964 A1 6/2005 Ruschke et al.
2005/0163554 A1 7/2005 Cara Sanchez
2005/0167307 A1 8/2005 Cheng
2005/0183984 A1 8/2005 Shih
2006/0013640 A1 1/2006 Skakoon et al.
2006/0088362 A1 4/2006 Chase et al.
2006/0127159 A1 6/2006 Demellier et al.
2006/0213912 A1 9/2006 Zaytoun
2006/0254945 A1 11/2006 Green et al.
2007/0104531 A1 5/2007 Thiebaut
2008/0075521 A1 3/2008 Vanoncini
2008/0101850 A1 5/2008 Wojcik et al.
2008/0286028 A1 11/2008 Lombardi
2009/0016799 A1 1/2009 Bellas
2009/0080963 A1 3/2009 Skakoon et al.
2009/0290928 A1 11/2009 Samuelson et al.
2009/0317168 A1 12/2009 Theroude
2009/0317169 A1 12/2009 Limongi
2009/0324317 A1 12/2009 Batchelor et al.
2011/0024316 A1 2/2011 Ginsburg
2011/0070012 A1 3/2011 Kim et al.
2011/0194884 A1 8/2011 Kim
2011/0215116 A1 9/2011 Fuller et al.
2012/0085672 A1 4/2012 Gelardi et al.
2012/0093565 A1 4/2012 Drew
2012/0228178 A1 9/2012 Nazari
2012/0228179 A1 9/2012 Bertken
2012/0251221 A1 10/2012 Breidenbach et al.
2013/0058700 A1 3/2013 Liu
2013/0230347 A1 9/2013 Kim
2013/0287468 A1 10/2013 Roppa
2014/0126948 A1 5/2014 Haynes
2014/0270892 A1 9/2014 Linehan
2015/0030372 A1 1/2015 Tani
2015/0136770 A1 5/2015 Wang
2015/0237990 A1 8/2015 Lin
2015/0250290 A1 9/2015 Holloway
2015/0272297 A1 10/2015 Gordon-Bryan
2015/0305475 A1 10/2015 Girod
2015/0366321 A1 12/2015 Anderson
2016/0037893 A1 2/2016 Walker
2016/0174685 A1 6/2016 Ellsworth
2016/0174686 A1 6/2016 Ellsworth

(56) References Cited

U.S. PATENT DOCUMENTS

| | | | |
|---|---|---|---|
| 2016/0235183 | A1 | 8/2016 | Lee |
| 2016/0249727 | A1 | 9/2016 | Kim et al. |
| 2016/0316887 | A1 | 11/2016 | Maehr |
| 2016/0345709 | A1 | 12/2016 | Endo et al. |
| 2017/0007003 | A1 | 1/2017 | Paquet |
| 2017/0035182 | A1 | 2/2017 | Bonnin et al. |
| 2017/0042310 | A1 | 2/2017 | Heraud et al. |
| 2017/0127798 | A1 | 5/2017 | Bartlett |
| 2017/0196339 | A1 | 7/2017 | Kim |
| 2017/0210508 | A1 | 7/2017 | Toh et al. |
| 2017/0215555 | A1 | 8/2017 | Fogueteiro |
| 2017/0325569 | A1 | 11/2017 | Lee et al. |
| 2017/0325570 | A1 | 11/2017 | Davtyan |
| 2017/0340088 | A1 | 11/2017 | Ishida |
| 2017/0354236 | A1 | 12/2017 | Corsi et al. |
| 2018/0008026 | A1 | 1/2018 | Kuo |
| 2018/0008027 | A1 | 1/2018 | Yeung et al. |
| 2018/0020809 | A1 | 1/2018 | Soga |
| 2018/0042360 | A1 | 2/2018 | Gibson |
| 2018/0084890 | A1 | 3/2018 | Lewis |
| 2018/0086541 | A1 | 3/2018 | Ellsworth et al. |
| 2018/0086542 | A1 | 3/2018 | Ellsworth et al. |
| 2018/0140074 | A1 | 5/2018 | Vacheron et al. |
| 2018/0199692 | A1 | 7/2018 | Olson et al. |
| 2018/0207413 | A1 | 7/2018 | Skakoon et al. |
| 2019/0029395 | A1 | 1/2019 | Porter et al. |

FOREIGN PATENT DOCUMENTS

| | | | |
|---|---|---|---|
| DE | 19643237 | A1 | 4/1998 |
| DE | 69227520 | | 5/1999 |
| EP | 0196385 | A2 | 10/1986 |
| EP | 0660679 | | 9/1999 |
| FR | 2766339 | | 1/1999 |
| FR | 2939413 | B1 | 2/2011 |
| GB | 2162822 | | 2/1986 |
| JP | D1112660 | | 6/2001 |
| JP | 2003061742 | | 3/2003 |
| JP | 2004106932 | | 4/2004 |
| JP | 2004321410 | | 11/2004 |
| JP | 3767885 | B2 | 4/2006 |
| JP | 5746947 | B2 | 7/2015 |
| JP | 6442324 | B2 | 12/2018 |
| KR | 200458000 | Y1 | 1/2012 |
| WO | WO2007093286 | | 8/2007 |
| WO | WO2014121259 | | 8/2014 |

OTHER PUBLICATIONS

Coffee Storage Canister, amazon.com posted by Coffmax on Apr. 20, 2016 © 1996-2019 Amazon.com, Inc., online, site visited Feb. 1, 2019. Available from Internet, URL: https://www.amazon.com/Coffee-Storage-Container-Airtight-Canister/dp/B01EJNX4QA/ref=as_at?creativeASIN=B01EJNX4QA&impr (Year: 2016).

Lip Balm, GoLiips, posted at goliips.com, date and author not listed ©, online, site visited May 25, 2018. Available from Internet, URL: https://gollips.com/ (Year: 2018).

Ultra-mini lip balm container, Federal Package, packworld.com, author not listed, May 13, 2013 © 2018 PMMI Media Group, online, site visited Apr. 20, 2018. Available from Internet, URL: https://www.packworld.com/article/package-type/containers/specialty/federal-package-ultra-mini-lip-balm-container (Year: 2013).

5.5 ml Lip Balm Tube, RGSellers, amazon.com, customer review with images posted Apr. 6, 2016 © 1996-2019 Amazon.com online, site visited Feb. 14, 2019. Available from Internet, URL: https://www.amazon.com/ Basic-Essential-Bottles-Empty-Yellow/dp/B01D5REAS2/ref=sr_1_1_s_it?s=beauty&ie=UTF8&qid . . . (Year: 2016).

Mini Lip Balm Tube Set, Elements Bath and Body, elementsbathandbody.com, author not listed, posted Jul. 19, 2016 per wayback machine © 2003-2019 Elements Bath & Body Supply, online, site visited Feb. 14, 2019. Available at URL: https://web.archive.org/web/20160719133043/https://www.elementsbath... (Year: 2016).

75 gram white styrene deodorant tubes, SKS Bottle & Packaging, Inc., soapdelinews.com, posted by Rebecca Dillon on Sep. 19, 2016 © 2019 Rebecca Dawn Dillon, online, site visited Apr. 23, 2019. Available from Internet, URL: http://soapdelines.com/tag/neem-oil/page/3 (Year: 2016).

Flower in tea caddy, Osaka-Naniwa, posted at japaneseteasommelier.com, published Jan. 27, 2015 by Florent © not listed, online, site visited Jun. 10, 2018. Available from Internet, URL: https://japaneseteasommelier.wordpress.com/2015/10/27/japanese-traditional-tin-ware/ (Year: 2015).

Tea canisters, Kaikado, posted at core77.com, published May 31, 2012 by Linyee Yuan © not listed, online, site visited May 23, 2018. Available from Internet, URL: http://www.core77.com/posts/22507/NY-Design-Week-2012-ICFF-Kaikado-Chazutsu_Japanese-Tea-Caddies (Year: 2012).

* cited by examiner

MATERIAL APPLICATOR

CROSS-REFERENCE TO RELATED APPLICATIONS

This application is a continuation of U.S. application Ser. No. 17/217,787, filed Mar. 30, 2021, now U.S. Pat. No. 11,382,400, which is a continuation of U.S. application Ser. No. 16/538,778, filed Aug. 12, 2019, which claims the benefit of U.S. Provisional Application No. 62/717,651, filed Aug. 10, 2018, the contents of all of these applications are herein incorporated by reference in their entirety.

BACKGROUND OF THE DISCLOSURE

The present disclosure relates to applicators of solid or semi-solid material for the lips, for example lip balm. Such applicators are configured as user operable dispensers where sticks of the material for the lips is dispensed by the user holding a casing with one hand, removing a cap from an upper dispense end of the casing, and selectively rotating a dial on a lower end of the casing to cause the stick of material for the lips to be extended from the upper end a convenient amount for application to the user's lips. After the material is applied, the unused material may be moved to a lower position in the dispenser by rotating the dial in an opposite direction and the cap may be placed back on the dispense end of the casing. The casings are generally cylindrically shaped and formed of an opaque polymer. The amount of material left in the dispenser may be determined by the tedious task of rotating the dial until the stick of material is dispensed the maximum amount. The stick of material will need to be retracted to replace the lid.

Such dispensers with sticks of material to apply to the lips are manufactured and sold in quantities of many millions annually and are readily available in retail stores and online environments. The industry and market place is thus highly competitive. Any visually perceivable features or advantages that a potential customer may see presented at the point of sale would be advantageous to selling such a product. Any improvements in a user's actual use of and experience with a product would drive repeat sales and be well received by the industry. Moreover, any cost savings in manufacturing such dispensers would drive lower price to the consumer and/or better margins to the manufacturers, distributors, and retailers and would be well received by these groups.

SUMMARY

A dispenser of material for the lips comprises a casing, a manually operable dispense mechanism attached to the casing, lip material in the casing and a cap to cover the lip material. The casing having an upper dispense end, a lower end, and defining a casing cavity. The dispense mechanism comprising an actuator having an actuating dial and a spindle extending therefrom. The spindle having a threaded portion that engages the nut portion of an elevator, the elevator slidingly engaged with the casing in the cavity and having a stick of the lip material thereon. The actuating dial retained at the lower end of the casing by way of circularly spaced cantilevered fingers extending from the lower end of the casing inwardly and upwardly to engage a retention flange on the spindle. The spindle further having a plurality of nubs or ribs circumferentially spaced about the spindle below the flange, the nubs or ribs interfacing with the plurality of fingers causing deflection and/or compression and releasing of the cantilevered fingers upon rotation of the dial thereby providing a tactile clicking and/or a variable rotation resistance of the dial.

In embodiments, the dispenser having an ergonomic shape, with an enlarged dispense end, a narrowed lower waist region and the dial diameter exceeding the diameter of the narrowed lower waist region and being less that the diameter of the enlarged dispense end. The casing having an inner wall which may be formed of a light transmissive polymer and an exterior layer of an opaque high friction gripping surface. The casing exterior surface may include the gripping surface and a surface of a radial projection portion from the inner wall such that the light transmissive portion extends from the cavity to the casing exterior surface and is exteriorly exposed.

During assembly, the spindle portion of the actuator be inserted into a downward open end of the casing opposite the dispense end, with a conical surface of the retention flange deflecting radially outward the cantilevered fingers allowing the flange to pass by ends of the fingers, the fingers snapping back into a retaining position below the flange after the flange passes by. The fingers interfacing with circumferentially spaced nubs or ribs on the spindle of the actuator such that rotation of the actuator by way of the dial causes deflection and snapping of the fingers caused by the interfacing of the fingers with the nubs or ribs thereby providing a tactile sensation and/or audibly detectable signal, and/or a variable resistance to rotation.

Such applicators are configured as user operable dispensers where sticks of the material for the lips is dispensed by the user holding a casing with one hand, removing a cap from an upper dispense end of the casing, and selectively rotating a dial on a lower end of the casing to cause the stick of material for the lips to be extended from the upper end a convenient amount for application to the user's lips. After the material is applied, the unused material may be moved to a lower position in the dispenser by rotating the dial in an opposite direction and the cap may be placed back on the dispense end of the casing.

A certain amount of resistance in a mechanism in the applicator used to raise and lower the material may reduce the likelihood that the material moves when it is not being used. A certain amount of resistance in the mechanism used to raise and lower the material may also provide tactile feedback to the user. A feature and advantage is that the tactile feedback, for example a certain number of clicks, can indicate to a user that a stick of material has been dispensed sufficiently out of the casing for easy application to the lips. Certain users may choose a particular product based on the tactile feel provided by the applicator. Accordingly, a material applicator that provides tactile feedback as the base is rotated and reduces the likelihood that unintentional material movement will occur would be welcomed by the industry.

A feature and benefit of embodiments is an arrangement for material applicators in which the number of components that are assembled is minimized, the assembly is simple, the steps for assembly are minimized, and the assembly is very conducive to robotic assembly.

In embodiments, the material applicators include a plurality of cantilevered arms and a casing that are unitarily formed from a single piece of thermoplastic material.

A feature and benefit of embodiments is an arrangement for material applicators in which the individual components of the material applicators can be assembled to each other using snap-fit and/or screw thread arrangements without the use of fasteners, tools, adhesives, or weld joints.

A feature and benefit of embodiments is a material applicator including a spindle and a casing that are assembled together using a snap-fit arrangement. In embodiments, the casing includes a plurality of cantilevered fingers and the spindle includes a conical ramping portion that deflects the cantilevered arms during assembly.

A feature and advantage of embodiments is a flared casing with a flush cap thereon providing an enlarged upper end of the dispenser, and a diametrically smaller actuator dial. Such is visually suggestive to a consumer of a dispenser with a greater lip balm capacity and therefore suggestive of greater value. Moreover, the diametrically enlarged size of the upper end of the casing provides ergonomically friendly grasping of the casing between the user's forefinger and thumb of one hand and delicately manipulating the diametrically reduced size dial with the forefinger and thumb of the user's other hand. The dial being sized closer to the dial size of the conventional cylindrical lip balm dispenser of 0.60 to 0.63 inches in diameter of which consumers are typically accustomed.

A feature and advantage of embodiments is an actuator portion that extends radially beyond a casing so that the actuator portion is easily engaged with the finger tips of a user.

A feature and advantage of embodiments is an arrangement that provides a tactile feeling of continuous resistance rather than discrete clicks. In embodiments, the arrangement provides the tactile feeling of continuous resistance when the spindle is rotated in both clockwise and counterclockwise directions. In embodiments, the resistance to clockwise rotation is substantially equal to the resistance to counterclockwise rotation.

A feature and advantage of embodiments is a textured elastomeric surface for gripping the container.

A material applicator in accordance with an example embodiment comprises a casing having a casing wall with an open upper end and a cylindrically shaped actuating dial portion positioned below the casing. In embodiments, the actuating dial portion has an outer diameter equal to or greater than a diameter of the casing. In embodiments, an elevator is slidingly disposed inside a cavity defined by the casing wall and the material to be dispensed is located in the cavity above the elevator. In embodiments, the material applicator includes an elevator mechanism comprising a threaded drive spindle threadingly engaging a thread engaging portion of the elevator. In embodiments, the threaded drive spindle is fixed to the actuating dial portion whereby rotating the actuating dial portion in a first direction raises the elevator and rotating the actuating dial portion in a second direction lowers the elevator. In embodiments, the material applicator includes a resistance mechanism providing resistance to rotation of the threaded drive spindle. In embodiments, the resistance mechanism comprises a plurality of cantilevered fingers supported by the casing and a plurality of ribs supported by the threaded drive spindle. In embodiments, each rib extends radially outward beyond a outer surface of the threaded drive spindle and each rib extends upward and downward along the outer surface. In embodiments, each cantilevered finger has a distal portion selectively contacting the outer surface and each cantilevered finger is subjected to cantilevered bending so the distal portion of each cantilevered finger is biased toward the outer surface. In embodiments, a cam action of each rib causes additional cantilevered bending in the cantilevered fingers whereby resistance to rotation is produced as the cam action of the ribs causes the cantilevered fingers to flex. In embodiments, the casing has a lower end, an upper end, and a casing wall extending upward from the lower end to the upper end. In embodiments, the casing wall defines a cavity extending along a central axis, the casing wall extending in an arcuate path around the central axis and the cavity. In embodiments, the casing wall supports a plurality of cantilevered fingers proximate the lower end, each cantilevered finger extending away from the casing wall toward the central axis and each cantilevered finger extending upward away from the lower end of the casing wall.

A material applicator in accordance with an example embodiment comprises a casing having a lower end, an upper end, and a casing wall extending upward from the lower end to the upper end. In embodiments, the casing wall defines a cavity extending along a central axis and the casing wall extends in an arcuate path around the central axis and the cavity. In embodiments, the lower end of the casing wall supports a plurality of cantilevered fingers. In embodiments, each cantilevered finger extends away from the casing wall toward the central axis. In embodiments, each cantilevered finger extends upward away from the lower end of the casing wall. The material applicator may also include an elevator that is slidingly disposed inside the cavity defined by the casing wall. The material may be located in the cavity above the elevator. The material applicator may include an dispense mechanism that selectively moves the elevator upward and downward along the central axis. In embodiments, the dispense mechanism comprises the elevator and a spindle having a thread. In embodiments, the thread engages the elevator. The spindle extends upward into the cavity from a base portion in embodiments. Rotation of the base portion may cause the elevator to move upward or downward along the thread of the spindle within the cavity causing the material to move upward or downward relative to the casing. In embodiments, the material applicator includes a resistance mechanism providing resistance to rotation of the spindle. In embodiments, the resistance mechanism comprises the cantilevered fingers supported by the casing and a plurality of ribs supported by the spindle. In embodiments, each rib extends radially outward beyond a outer surface of the spindle. In embodiments, each rib extends upward and downward along the outer surface. In embodiments, each cantilevered finger has a distal portion selectively contacting the outer surface of the spindle. In embodiments, each cantilevered finger is subjected to cantilevered bending so the distal portion of each cantilevered finger is biased toward the outer surface. During rotation of the base portion, a cam action of each rib may cause additional cantilevered bending in the cantilevered fingers whereby resistance to rotation is produced as the cam action of the ribs causes the cantilevered fingers to flex.

A material applicator in accordance with an example embodiment comprises a actuator having a base portion, a threaded shaft portion, and an intermediate portion disposed between the base portion and the shaft portion. In embodiments, the base portion has a disk or cylindrical base shape with a base diameter and a base height, the base diameter being greater than the base height. In embodiments, the shaft portion defines an inner shaft portion cylinder and an outer shaft portion cylinder and the shaft portion includes a male thread following a helical path between the inner shaft portion cylinder and the outer shaft portion cylinder. In embodiments, the shaft portion has a shaft portion height and a shaft portion outer diameter, the shaft portion height being greater than the shaft portion outer diameter. In embodiments, the intermediate portion has a lower portion, an upper portion and a camming portion disposed between the lower portion and the upper portion. In embodiments, the lower portion has four flanges, the four flanges being arranged so that the lower portion has a cross shape when viewed as a cross-section with the cross-sectional plane being orthogonal to the central axis. In embodiments, the upper portion defines a cone. In embodiments, the camming portion defines an inner cam cylinder and an outer cam cylinder. In embodiments, the camming portion includes a plurality of ribs, each rib being located between the inner cam cylinder and the outer cam cylinder and each rib having a longest dimension extending upward and downward. The material applicator may also include a casing having a lower end, an upper end, and a casing wall extending upward from the lower end to the upper end. In embodiments, the casing wall defines a cavity extending along a central axis and the casing wall extends in an arcuate path around the central axis and the cavity. In embodiments, the lower end of the casing wall supports a plurality of cantilevered fingers. In embodiments, each cantilevered finger extends away from the casing wall toward the central axis. In embodiments, each cantilevered finger extends upward away from the lower end of the casing wall. In embodiments, each cantilevered finger has a distal portion selectively contacting a outer surface of the camming portion of the spindle of the actuator. In embodiments, the outer surface of the camming portion defines the inner cam cylinder. In embodiments, each cantilevered finger is subjected to cantilevered bending so the distal portion of each cantilevered finger is biased toward the outer surface. During rotation of the actuator, a cam action of each rib may cause additional cantilevered bending in the cantilevered fingers, whereby resistance to rotation is produced as the cam action of the ribs causes the cantilevered fingers to flex.

A feature and advantage of embodiments is a lip balm dispenser with a volumetric balm capacity of about 0.250 cubic inches to about 0.40 cubic inches. In embodiments, the total volumetric capacity of lip balm is about 0.28 to 0.32 cubic inches. In embodiments the total dispenser height is about 1.50 inches to 1.90 inches and has a maximum casing diameter of about 0.80 to 1.00 inches with a minimum casing diameter below the maximum casing diameter of 80 to 90% of the maximum diameter of the casing. The ring has an outside dial diameter of 1 to 5% less than the minimum casing diameter. The casing below the minimum casing diameter having a casing diameter 1 to 5% greater than the minimum casing diameter. In embodiments the total dispenser height with the lid is about 1.65 to 1.85 inches. In embodiments the total dispenser height with lid is 1.75 inches to 1.80 inches.

A feature and advantage of embodiments is a stick dispenser with a casing having an exterior surface that comprises a textured opaque elastomeric material and also has at the casing exterior surface indicia formed of a light transmissive portion.

A feature and advantage of embodiments is a stick dispenser with a casing having an exterior surface that comprises a textured opaque elastomeric material and also has at the casing exterior surface a light transmissive region. In embodiments the light transmissive region having a border that is entirely within and surrounded by the opaque elastomeric material.

A feature and advantage of embodiments is a stick dispenser with a casing having an exterior layer that comprises opaque polymeric material and also has at the casing exterior surface a portion of an inner casing wall that projects radially outward through openings in the opaque polymeric material and is exposed at the casing exterior surface. The inner casing wall of a polymeric material different than the polymeric material of the exterior layer. In embodiments, the inner layer formed of a light transmissive material. In embodiments the inner layer is formed of polypropylene. In embodiments the inner layer is formed of polycarbonate. In embodiments the portion of the inner casing wall that projects radially outward is configured as indicia. In embodiments the indicia comprises alphabet letters. In embodiments the portion of the inner casing wall that projects radially outward is configured as a window for providing information on the amount of material available to be dispensed in the dispenser. In embodiments the portion of the inner casing wall that projects radially outward is configured as a window for providing information on the position of the elevator in the dispenser.

A feature and advantage of embodiments is a dispenser with a casing having an exterior surface that comprises a textured elastomeric material and a light transmissive portion that provides an amount of balm in the dispenser indication.

The above summary is not intended to describe each illustrated embodiment or every implementation of the present disclosure.

DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1A:
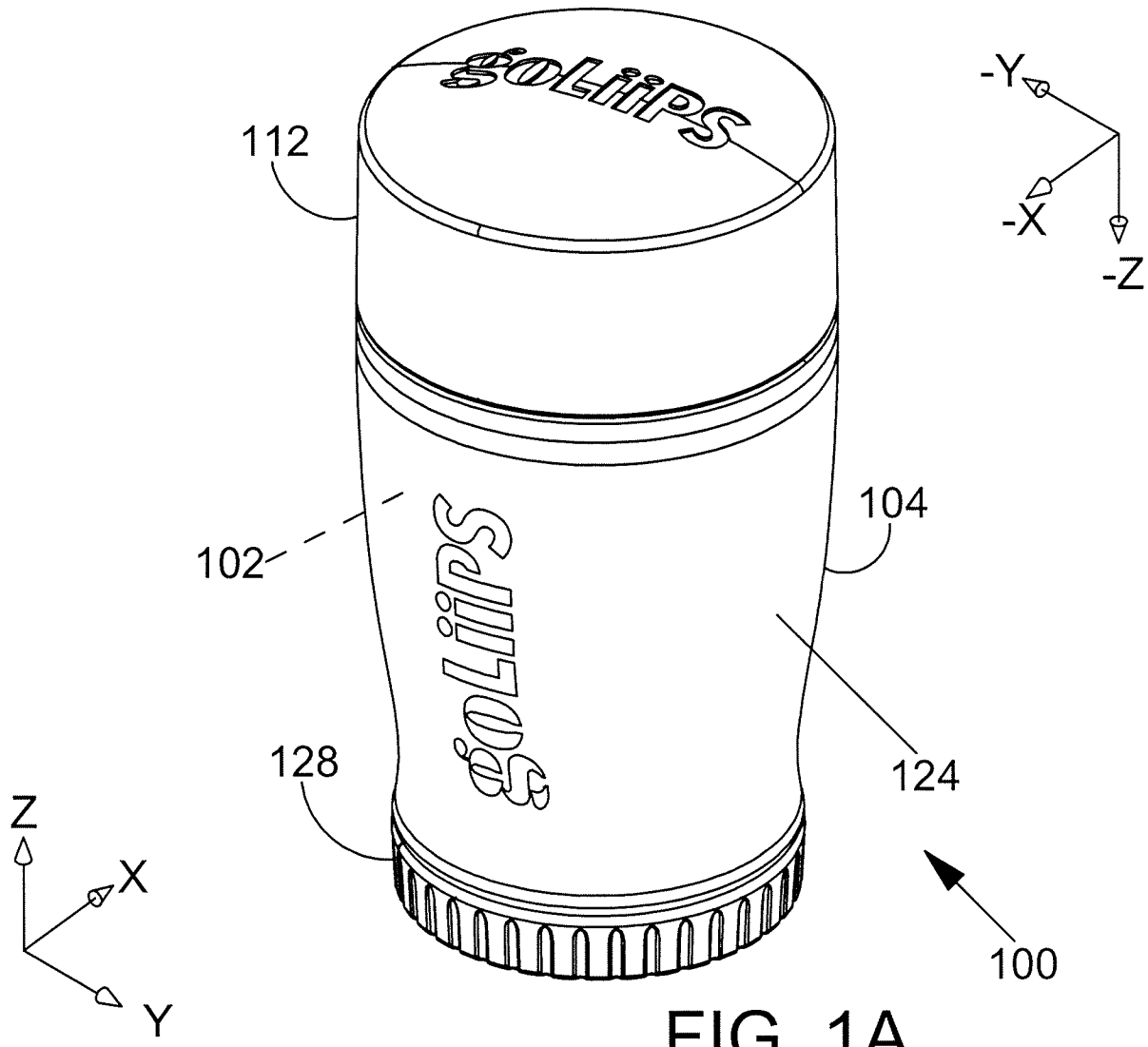
FIG. 1A is a perspective view showing a material applicator according to an embodiment of the invention.
Figure 1B:
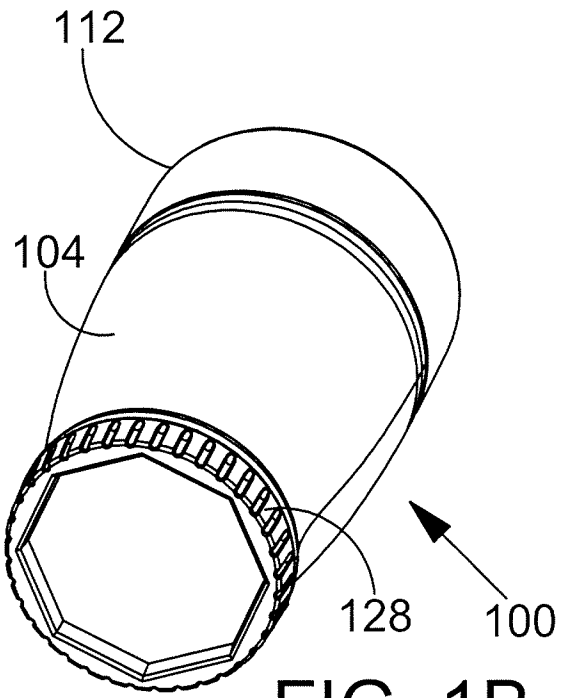
FIG. 1B is a rear perspective view showing a material applicator according to an embodiment of the invention.
Figure 1C:
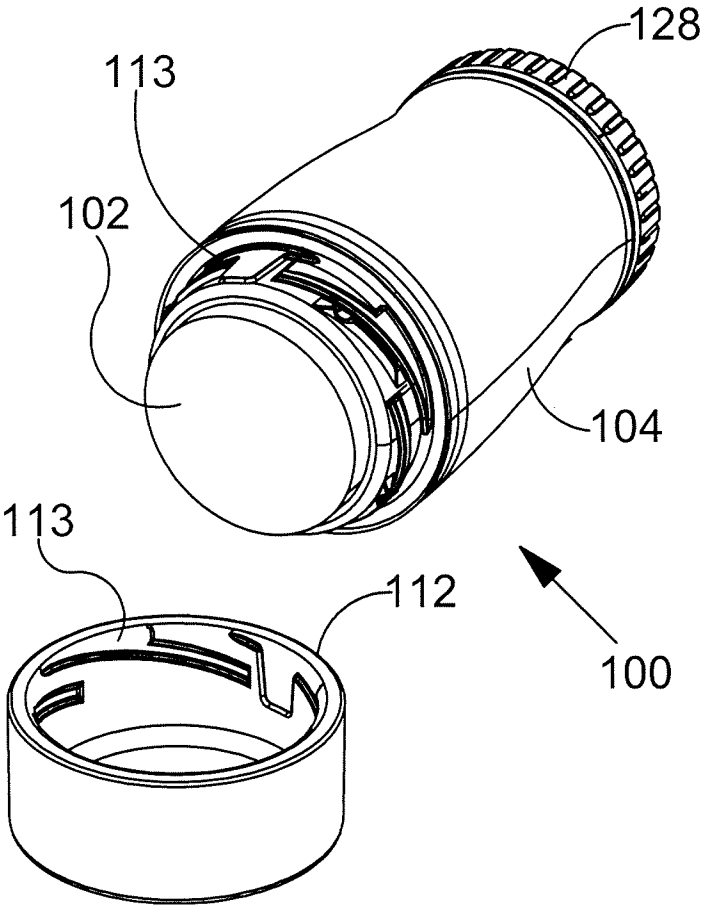
FIG. 1C is a perspective view showing a material applicator with a removed cap according to an embodiment of the invention.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIGS. 1A-2C, a material applicator 100 may be provided for holding and dispensing or applying a material 102 to a target location. In embodiments, the material 102 may comprise a lip balm that is applied to the lips of a user. In embodiments, the material applicator 100 comprises a casing 104, a lid, cap or cover 112 and a dispense mechanism 106. When the material applicator 100 is filled with the material 102, the dispense mechanism 106 may selectively move the material 102 upward and downward along a central axis 110 by rotating an actuating dial portion 128 of the dispense mechanism 106. FIG. 1C shows an embodiment of the material applicator 100 with the lid 112 removed and the material 102 exposed. In embodiments, the lid 112 may be secured to the casing 104 via mating threading 113 of the lid 112 and the casing.

Figure 2A:
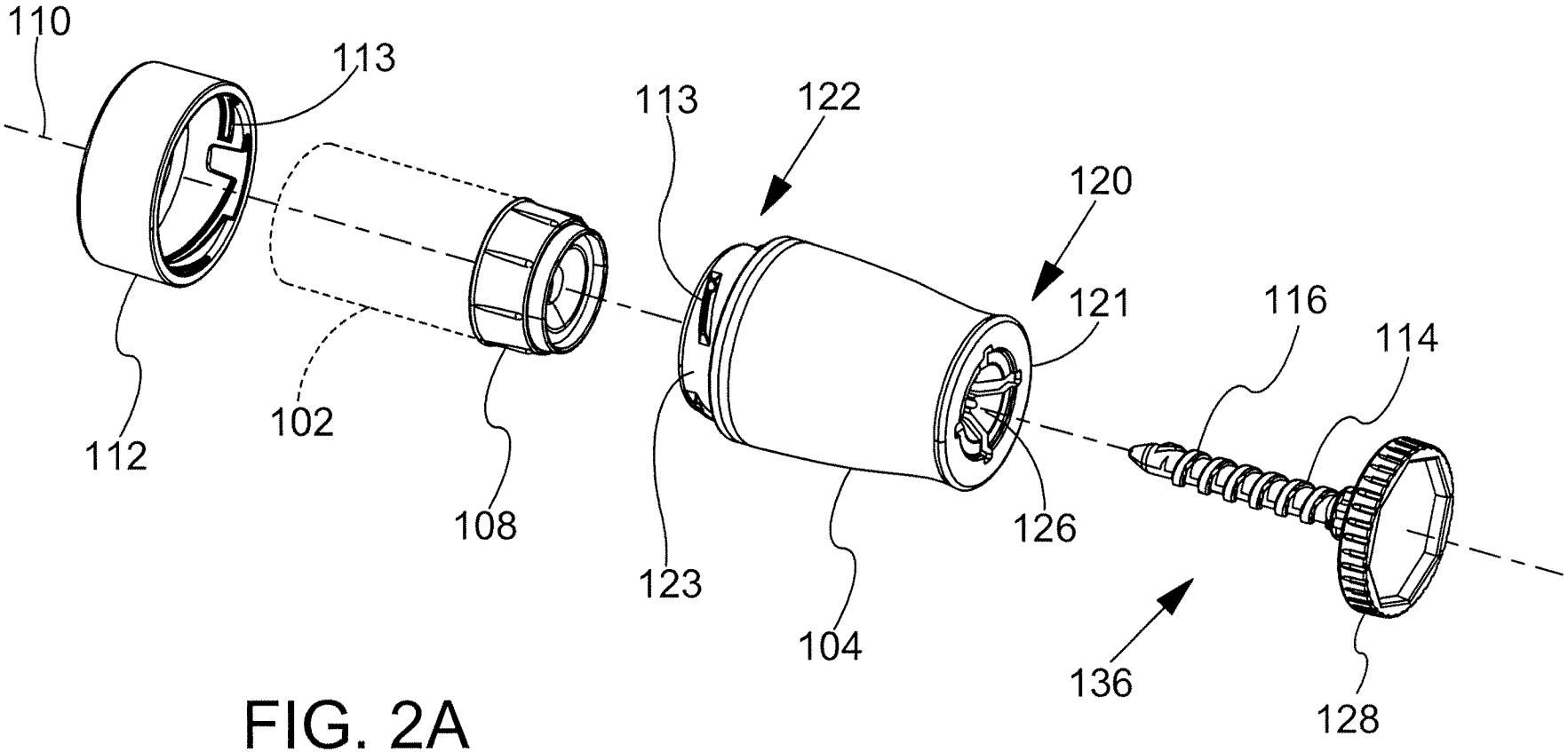
FIG. 2A is an exploded perspective view further illustrating the material applicator shown in FIG. 1A according to an embodiment of the invention.
Figure 2B:
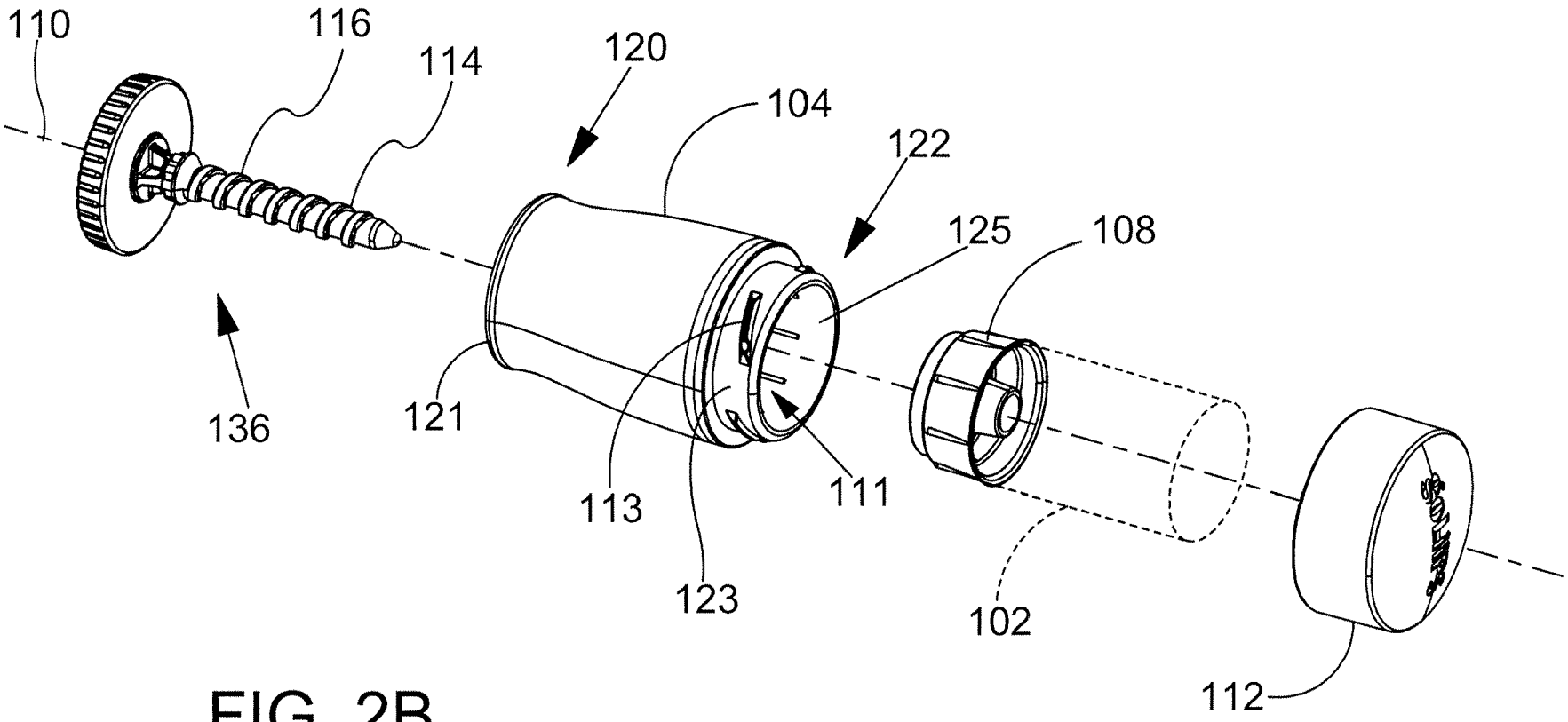
FIG. 2B is an additional perspective view further illustrating material applicator shown in FIG. 1A according to an embodiment of the invention.
Figure 3A:
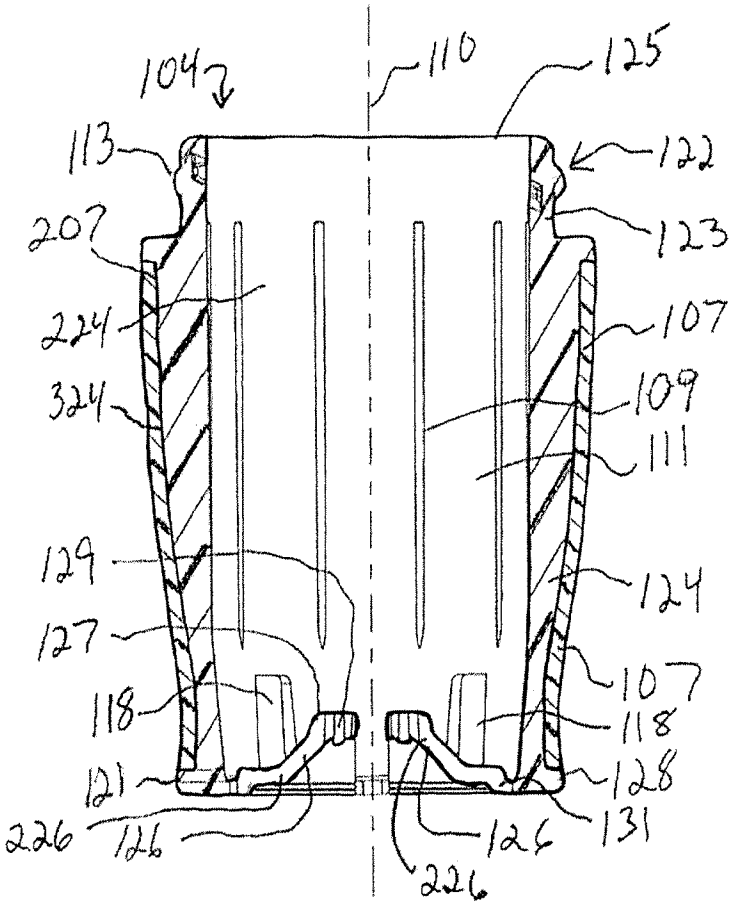
FIG. 3A is a cross-section view showing a casing of a material applicator according to an embodiment of the invention.

FIGS. 2A-2B show exploded views of a material applicator 100. In embodiments, the casing 104 may comprise a base portion 121 at a lower end 120, a neck portion 123 and an opening or mouth 125 at an upper end 122 and a casing wall 124 therebetween. The neck portion 123 may comprise mating threading to engage the mating threading 113 of the cap 113. In embodiments, the dispense mechanism 106 may comprise an elevator 108 and a actuator 136, which may comprise a spindle 114 having a thread 116 and an actuating dial portion or rotary wheel 128. In embodiments, the thread 116 of the spindle 114 engages a thread engaging portion 115 of the elevator 108 so that the elevator 108 moves upward or downward along the thread 116 of the spindle 114, causing the material 102 to move upward or downward relative to the casing 104.

Figure 2C:
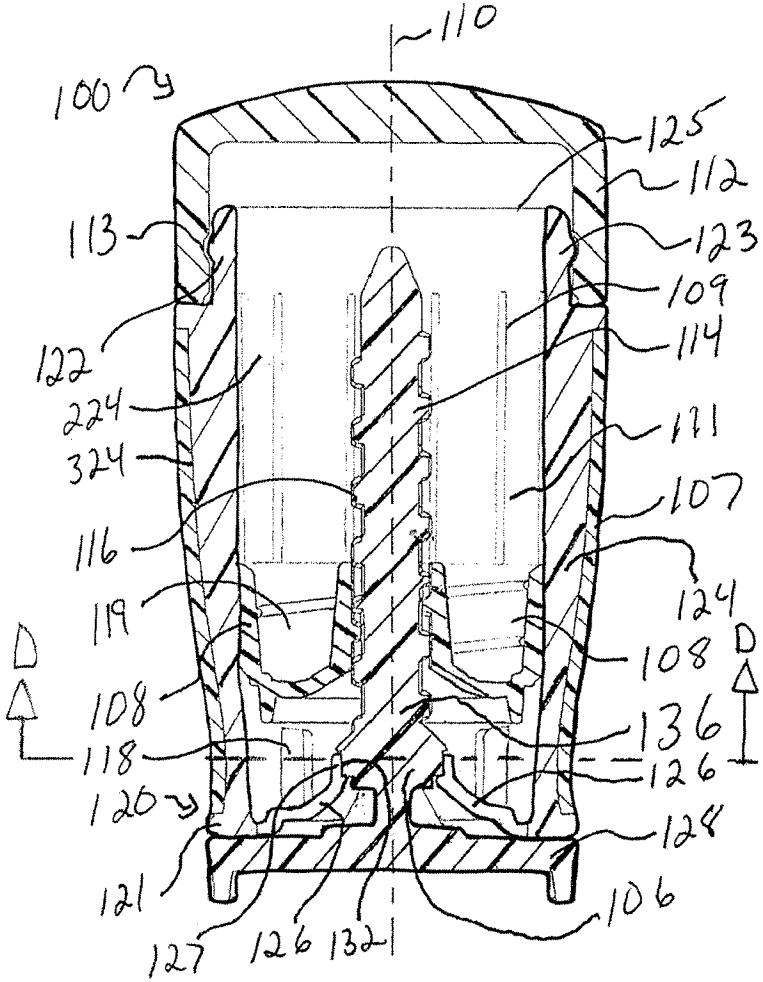
FIG. 2C is a cross-section view showing a material applicator according to an embodiment of the invention.

Referring to FIG. 2C, a cross-section view of a material applicator 100 in accordance with an example embodiment is shown. The material applicator 100 may have a cap 112 engaged with a neck portion 123 of casing 104 via mating threading 113. The casing 104 may comprise a base portion 121 at a lower end 120, the neck portion 123 and an opening or mouth 125 at an upper end 122 and a casing wall 124 there between. The case wall 124 may comprise an inner surface 224 and an outer surface 324 and define a cavity 111. A dispense or elevating mechanism 106 may be inserted through the base portion 121 and into the cavity 11. The dispense mechanism 106 may comprise a thread engaging portion 115 of an elevator 108 engaged with thread 116 of a spindle 114 of an actuator 136. In embodiments, the elevator 108 may be slidingly disposed inside the cavity 111 and the material 102 may be dispensed and held in an interface portion 119 of the elevator 108 and the cavity 111 above the elevator 108. The elevator 108 of the dispense mechanism 106 is shown in a lowered position.

FIGS. 3A-3E illustrate embodiments of the casing 104. In embodiments, the casing wall 124 may extend in an arcuate path around the central axis 110 and the cavity 111. In embodiments, the casing wall 124 may include inner wall ribs 109 and base ribs 118, both extending inwardly from the inner surface 224 of the casing wall 124. In embodiments, the inner wall ribs 109 may be elongated, extending axially on the inner surface 224 of the case wall 124. The inner wall ribs 109 may be symmetrically disposed around the axis 110. In embodiments, the base ribs 109 may extend axially from the base portion 121 of the casing 104 and radially inward from the inner surface 224 of the case wall 124. The inner wall ribs 109 may be symmetrically disposed around the axis 110. In embodiments, the casing 104 may comprise four base ribs 118.

In embodiments, the casing 104 may comprise a plurality of cantilevered fingers 126 extending from and supported by the base portion 121 of the casing 104. In embodiments, each cantilevered finger 126 has a distal portion 127 and a base portion 131 fixed to or unitary with the base portion 121 of the casing 104. Each cantilevered finger 126 may extend inwardly and upwardly away from the base portion 121 and lower end 120 of the casing wall 124 toward the central axis 110.

Each distal portions 127 may include a seating portion 129. In embodiments, the seating portion 129 may comprise a concave portion or channel on an inner side of the distal portion 127 of a cantilevered finger 126.

In embodiments, each cantilevered finger 126 may be narrowing in width, as circumferentially measured around the axis 110, from its base portion 131 to its distal portion 127. In embodiments, each cantilevered finger 126 may have an upward bend portion 226. In embodiments, the upward bend portion 226 may be circumferentially formed in the cantilevered finger 126. In embodiments, each cantilevered finger 126 may have two or two or more bend portions 226.

In embodiments, the cantilevered fingers 126 may be spaced from one another and/or may be symmetrically disposed around the axis 110. Each cantilevered finger 126 may be radially aligned with a base rib 118. In embodiments, the casing 104 may comprises four cantilevered fingers 126.

In embodiments, the casing 104, including features addressed above and as shown in the figures, may be one unitary piece. For example, the casing 104 may be a molded unitary piece of polymeric material.

In embodiments, a material applicator may further include an overmold portion or layer 107 on the outer surface 324 of the case wall 124. For example, the overmold layer 107 may be a coating or layer of material, such as a polymeric, thermoplastic material, using conventional overlaying or overmolding techniques, or a layer formed by conventional extrusion coating. In embodiments, the overmold layer 107 may provide a soft, resilient feel to the user. In embodiments, the overmold layer 107 may be positioned in a circumferential channel 207 formed by the outer surface 324 of the casing 104.

Figure 3D:
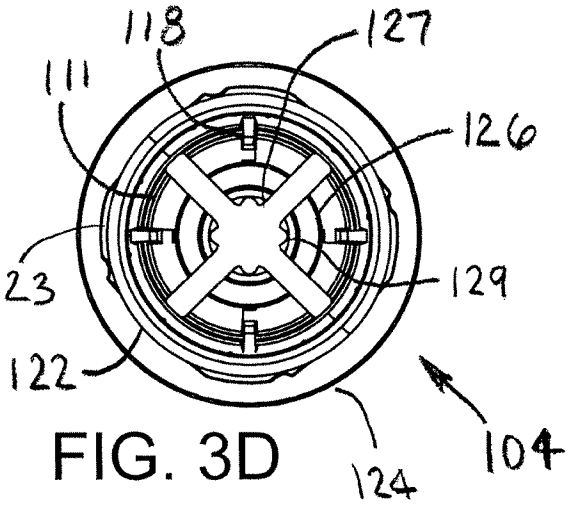
FIG. 3D is a top plan view showing a casing of a material applicator according to an embodiment of the invention.
Figure 3B:
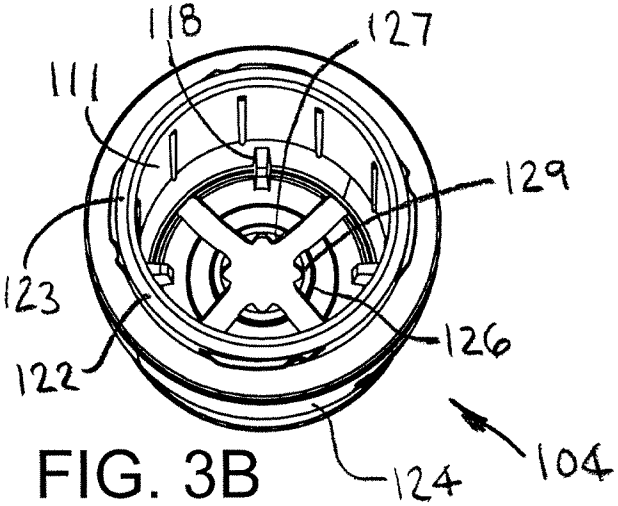
FIG. 3B is a top perspective view showing a casing of a material applicator according to an embodiment of the invention.
Figure 3E:
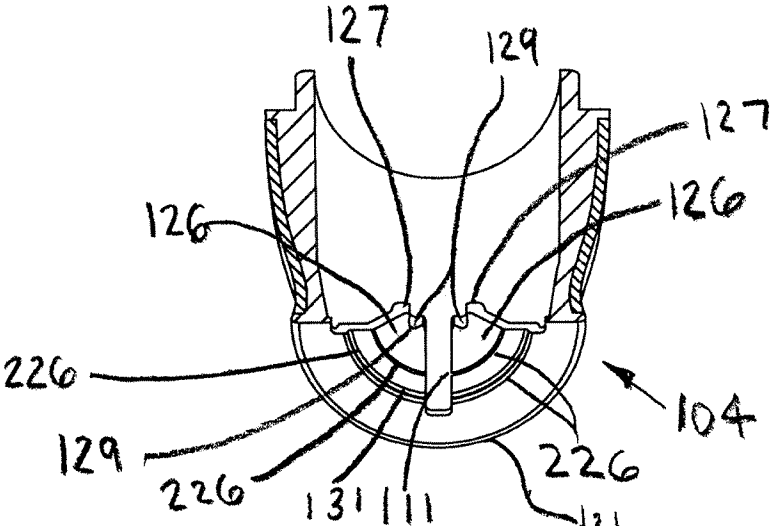
FIG. 3E is a bottom perspective view showing a portion of a casing of a material applicator according to an embodiment of the invention.
Figure 3C:
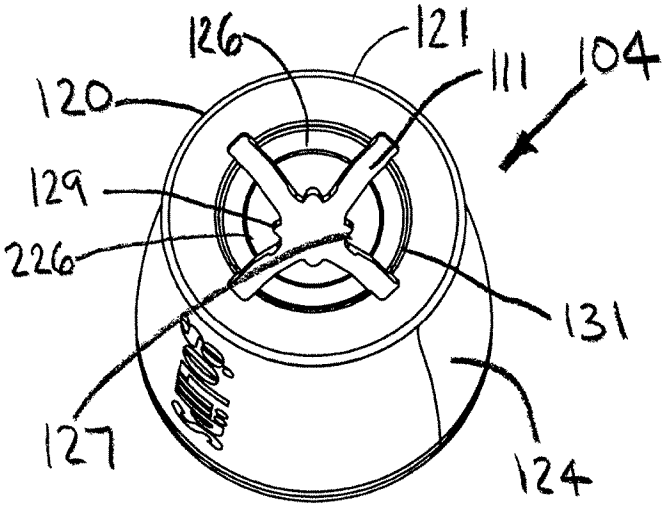
FIG. 3C is a bottom perspective view showing a casing of a material applicator according to an embodiment of the invention.

FIGS. 3B-3D show perspective views of a casing 104 in accordance with embodiments. FIG. 3E shows a blow up bottom perspective view of a portion of a base portion 121 of a casing 104, showing two cantilevered fingers 126.

Figure 4B:
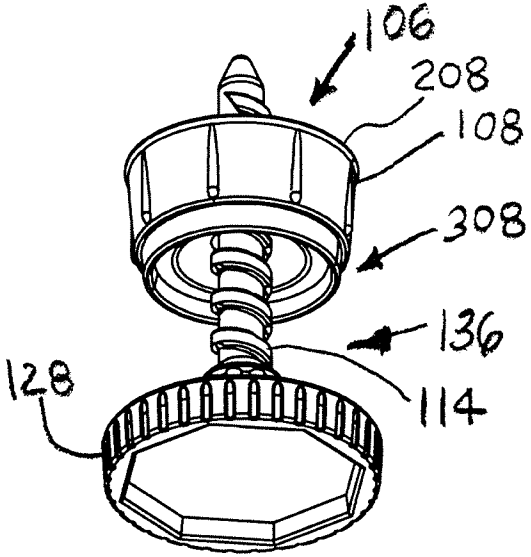
FIG. 4B is a bottom perspective view showing a component of a material applicator according to an embodiment of the invention.
Figure 4A:
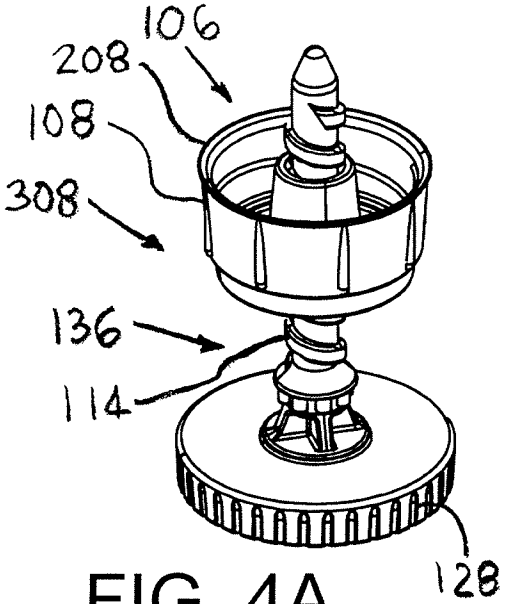
FIG. 4A is a top perspective view showing a component of a material applicator according to an embodiment of the invention.

Referring to FIGS. 4A-4B, an dispense mechanism 106 of a material applicator 100 may, in some embodiments, comprise an elevator 108 rotatably engaged with a actuator 136. The actuator 136 may comprise a spindle portion 114 fixed to an actuating dial portion 128. The spindle portion 114 may include a thread 116 that may threadingly engage a thread engaging portion 115 of the elevator 108. In embodiments, the threaded spindle 114 is fixed to the actuating dial portion 128, whereby rotating the actuating dial portion 128 in a first direction raises or drives the elevator 108 upward away from the actuating dial portion 128 and rotating the actuating dial portion 128 in a second direction lowers or drives the elevator 108 downward toward the actuating dial portion 128. In embodiments, the spindle portion 114 may be unitary with the actuating dial portion 128 and may be molded from a thermoplastic material.

Figure 5B:
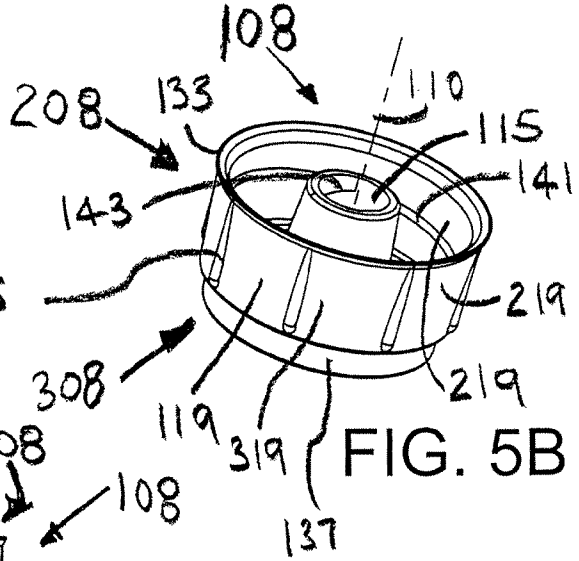
FIG. 5B is a top perspective view showing an elevator of a material applicator according to an embodiment of the invention.
Figure 5A:
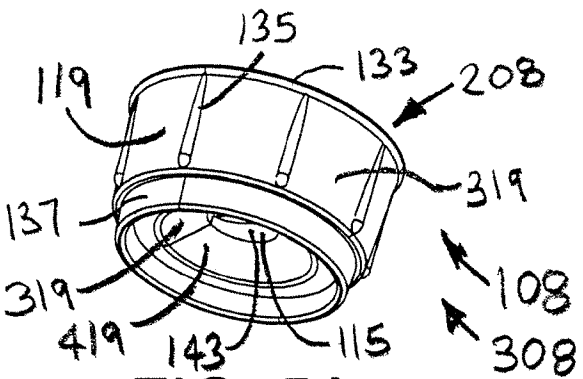
FIG. 5A is a bottom perspective view showing an elevator of a material applicator according to an embodiment of the invention.
Figure 5C:
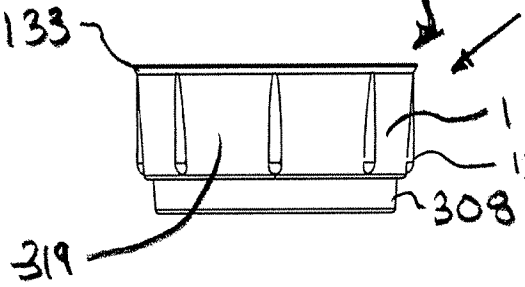
FIG. 5C is a side view showing an elevator of a material applicator according to an embodiment of the invention.
Figure 5D:
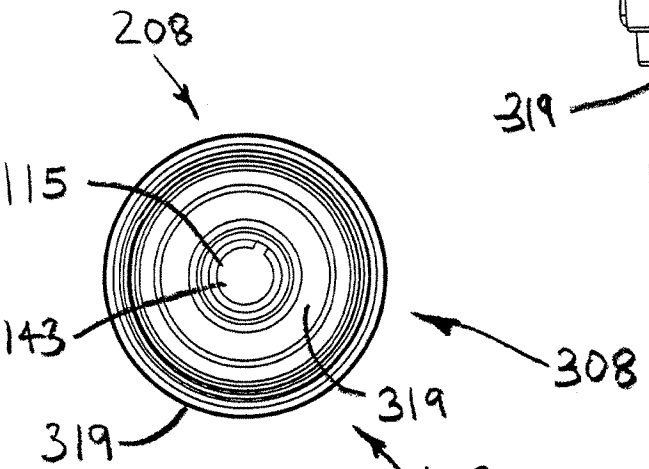
FIG. 5D is a top plan view showing an elevator of a material applicator according to an embodiment of the invention.
Figure 5E:
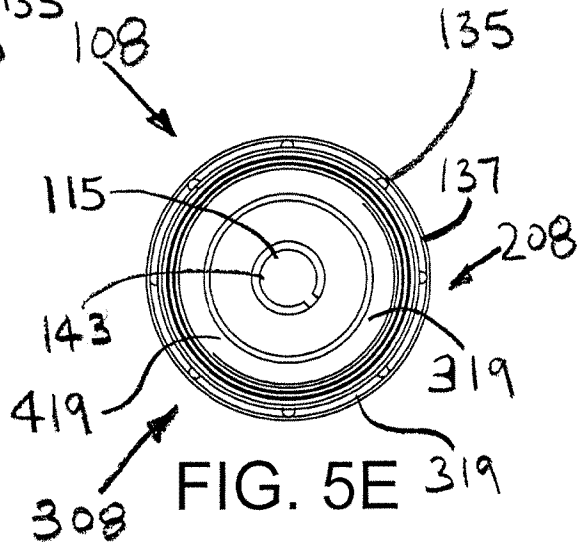
FIG. 5E is a bottom plan view showing an elevator of a material applicator according to an embodiment of the invention.
Figure 6A:
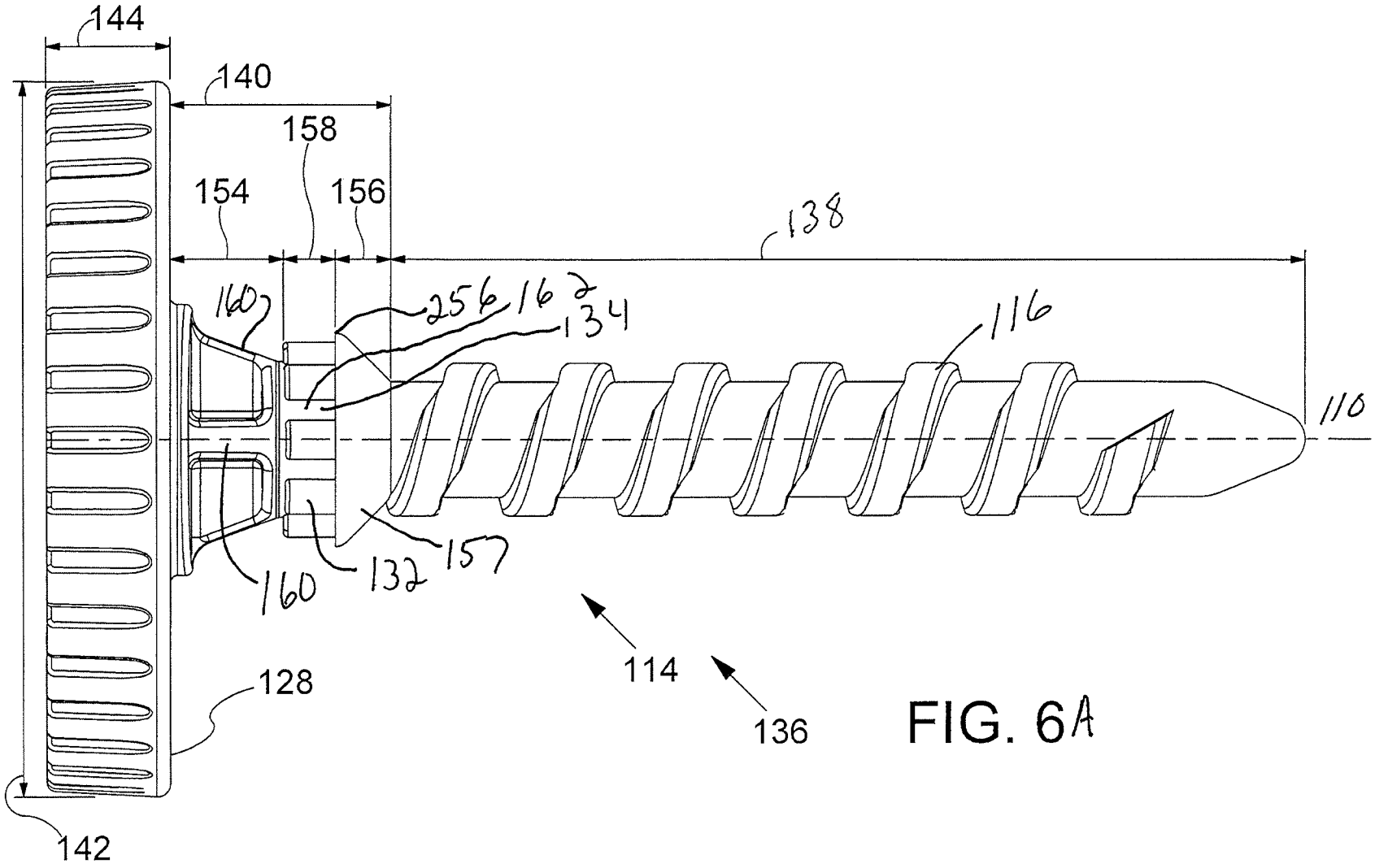
FIG. 6A is a side view showing a component of a material applicator according to an embodiment of the invention.
Figure 6B:
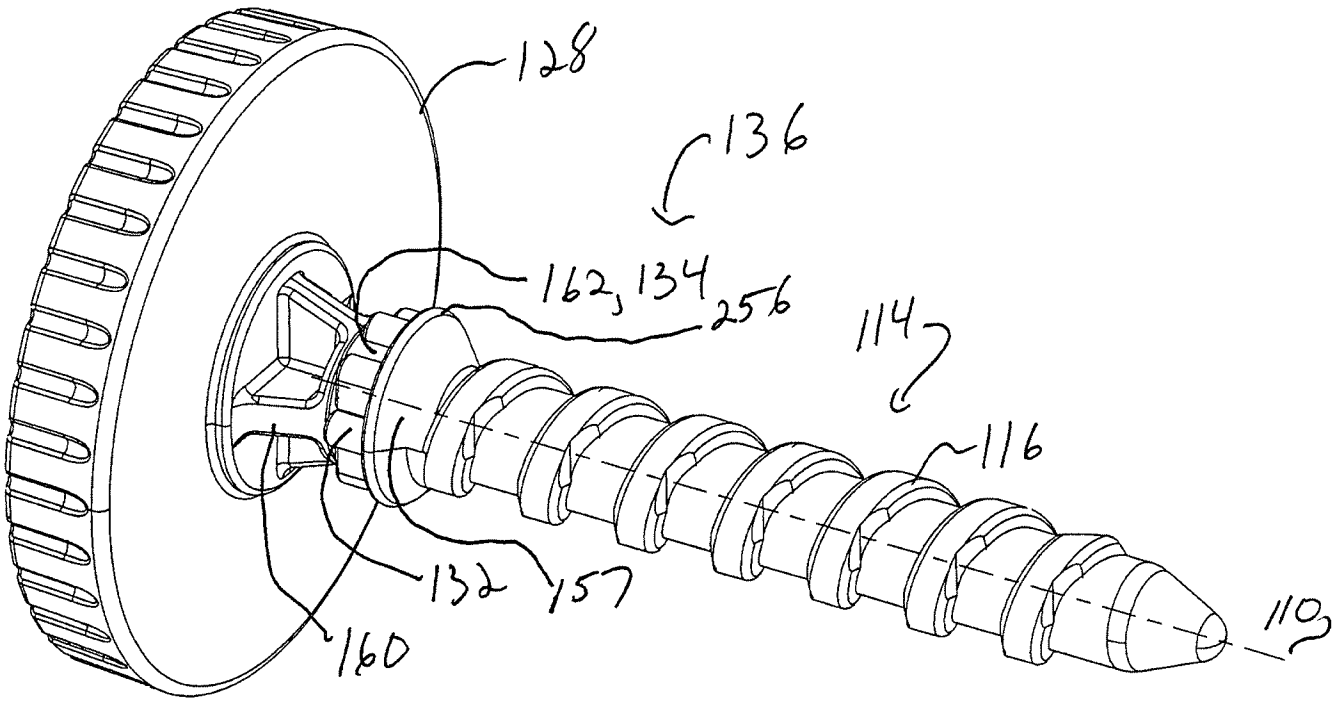
FIG. 6B is a perspective view showing a component of a material applicator according to an embodiment of the invention.
Figure 6D:
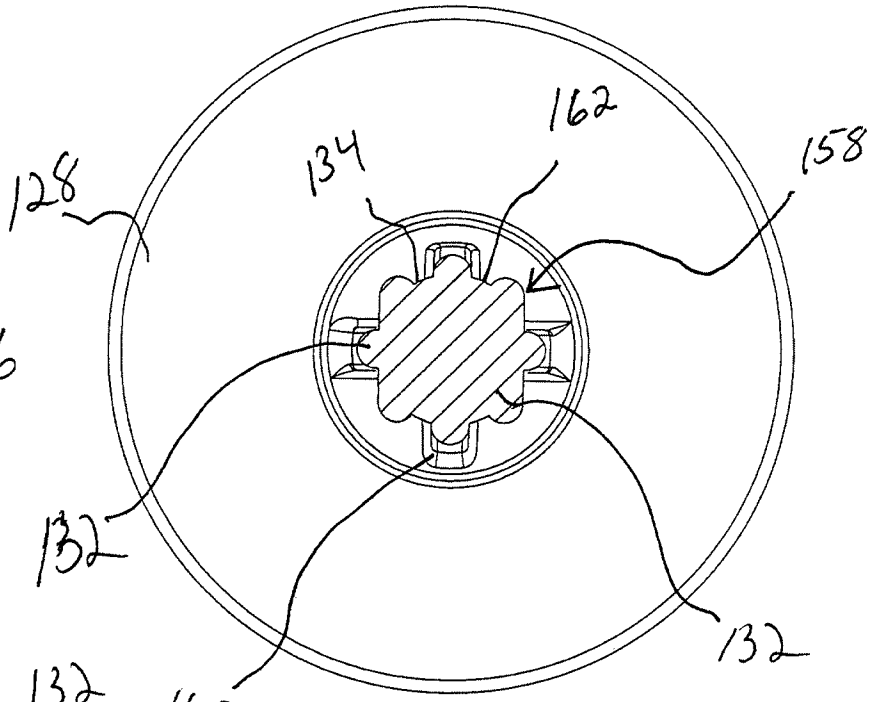
FIG. 6D is a cross-sectional top plan view of a component of a material applicator along line B-B of FIG. 6B according to an embodiment of the invention.
Figure 6E:
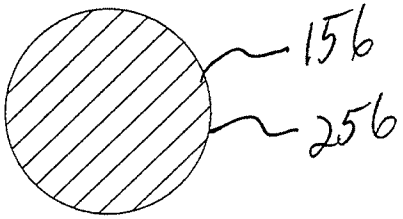
FIG. 6E is a cross-sectional top plan view of a component of a material applicator along line C-CB of FIG. 6B according to an embodiment of the invention.
Figure 6C:
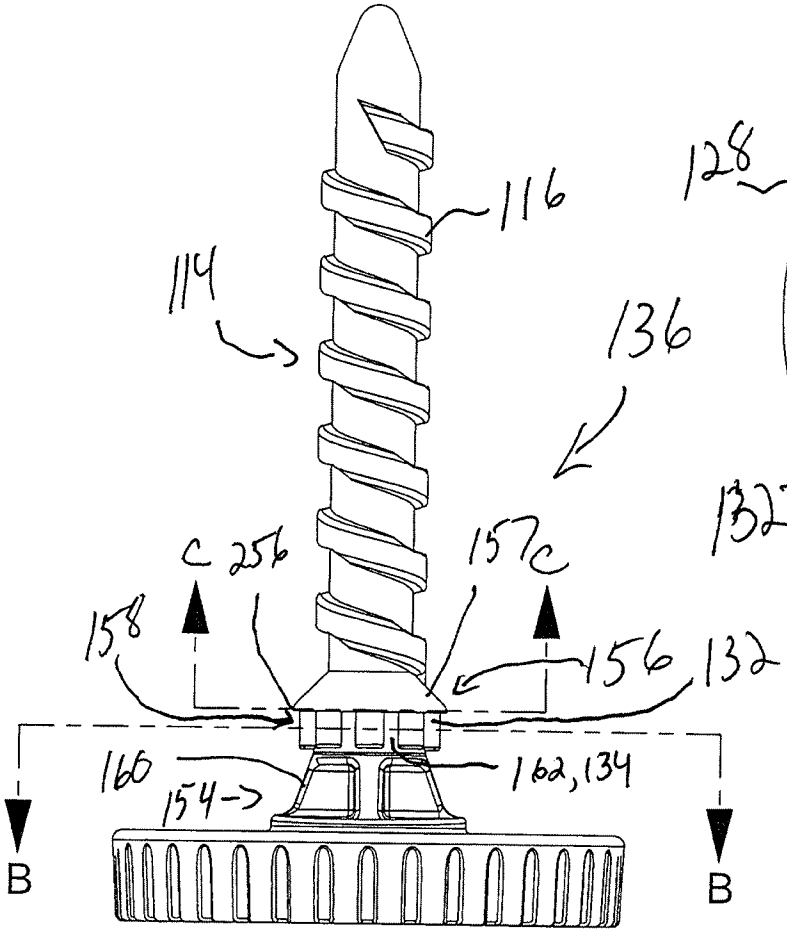
FIG. 6C is a side view showing a component of a material applicator according to an embodiment of the invention.
Figure 6G:
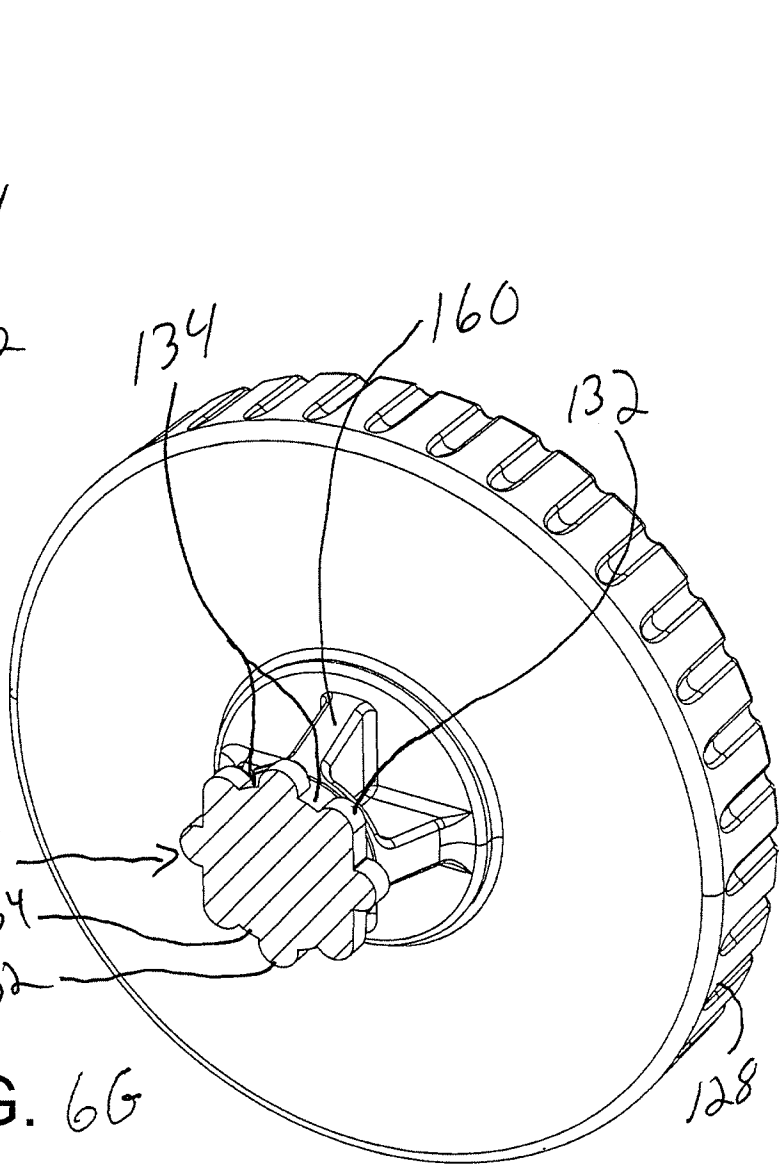
FIGS. 6F-6G are cross-sectional perspective views of a component of a material applicator along line B-B of FIG. 6B according to an embodiment of the invention.
Figure 6F:
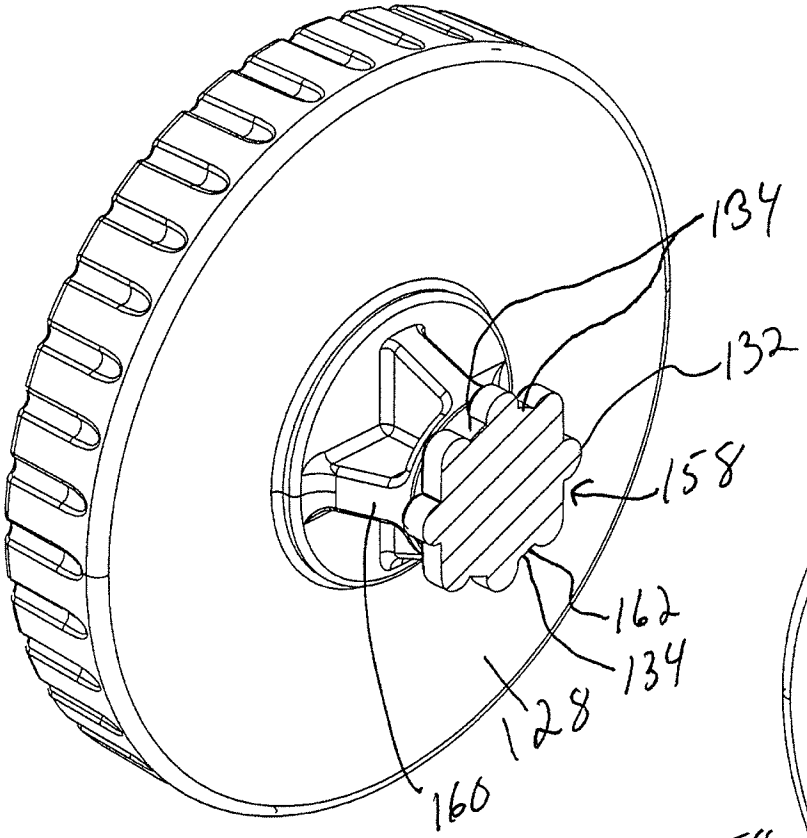

Referring to FIGS. 5A-4E, an elevator 108 of a material applicator 100 may, in some embodiments, comprise an upper end 208, a lower end 308, an interface portion 119 and an axially aligned central opening 143 and thread engaging portion 115 for receiving a spindle 114 of a actuator 136. In embodiments, the interface portion 119 may comprise an inner wall surface 219 and an outer wall surface 319. The inner wall surface 219 may comprise a thread 141 for engaging filled material 102 and the outer wall surface 319 may include axially oriented ribs 135. In embodiments, a lower portion 419 of the outer wall surface 319 may be downwardly oriented and angled upward toward the central axis 110. In embodiments, the elevator 108 may include a flared rim 133 at the upper end 208 and a base portion 137 at the lower end 308. The base portion 137 may comprise a circumferential ring extending downward from the interface portion 119.

Referring to FIGS. 6A-6F, a actuator 136 of a material applicator 100 may, in some embodiments, have a base portion or actuating dial portion 128 fixed to a spindle or spindle portion 114. The spindle 114 may comprise a shaft portion 138 and an intermediate portion 140 disposed between the base portion 128 and the shaft portion 138. In embodiments, the base portion 128 may have a cylindrical base shape with a base diameter 142 and a base height 144, the base diameter 142 being greater than the base height 144. In embodiments, the shaft portion 138 defines an inner shaft portion cylinder 146 and includes a male thread 116 following a helical path along an axis 110.

In embodiments, the intermediate portion 140 may include a lower support portion 154, an upper conical or tapered portion 156 and a camming portion 158 disposed between the lower support portion 154 and the upper tapered portion 156. In embodiments, the lower support portion 154 may include a plurality of support gussets or legs 160 extending downward to a top portion of the base portion 128. In some embodiments, the lower support portion 154 includes four gussets 160. The gussets 160 may be flared or angled outwardly from a common central position and may be arranged so that the lower support portion 154 has a cross shape when viewed as a cross-section with the cross-sectional plane being orthogonal to the central axis 110.

In embodiments, the upper tapered portion 156 may have a truncated conical shape with an conical outer surface 157 and a flange portion 256 with a rearward or downwardly facing surface 258 that may be perpendicular to the axis diameter at its lower base. In some embodiments, the angled circumferential outer surface 157 may receive and mate with a lower portion 419 of the outer wall surface 319 of an elevator 108.

In embodiments, the camming portion 158 defines an inner cam cylinder 162 having an outer outer surface 134. In embodiments, the camming portion 158 includes a plurality of ribs 132, each rib 132 running axially on and extending radially from the outer outer surface 134. In embodiments, the ribs 132 of the camming portion 158 may be elongated, having a greater axial length than its circumferential width on the outer surface 134. In embodiments, the inner cam cylinder may be cylindrical with the ribs 132 are circumferentially spaced by outer outer surface 134 portions.

In some embodiments, the actuator 136 may be a unitary piece and may be a molded polymeric unitary piece.

Figures 7A, 7B:
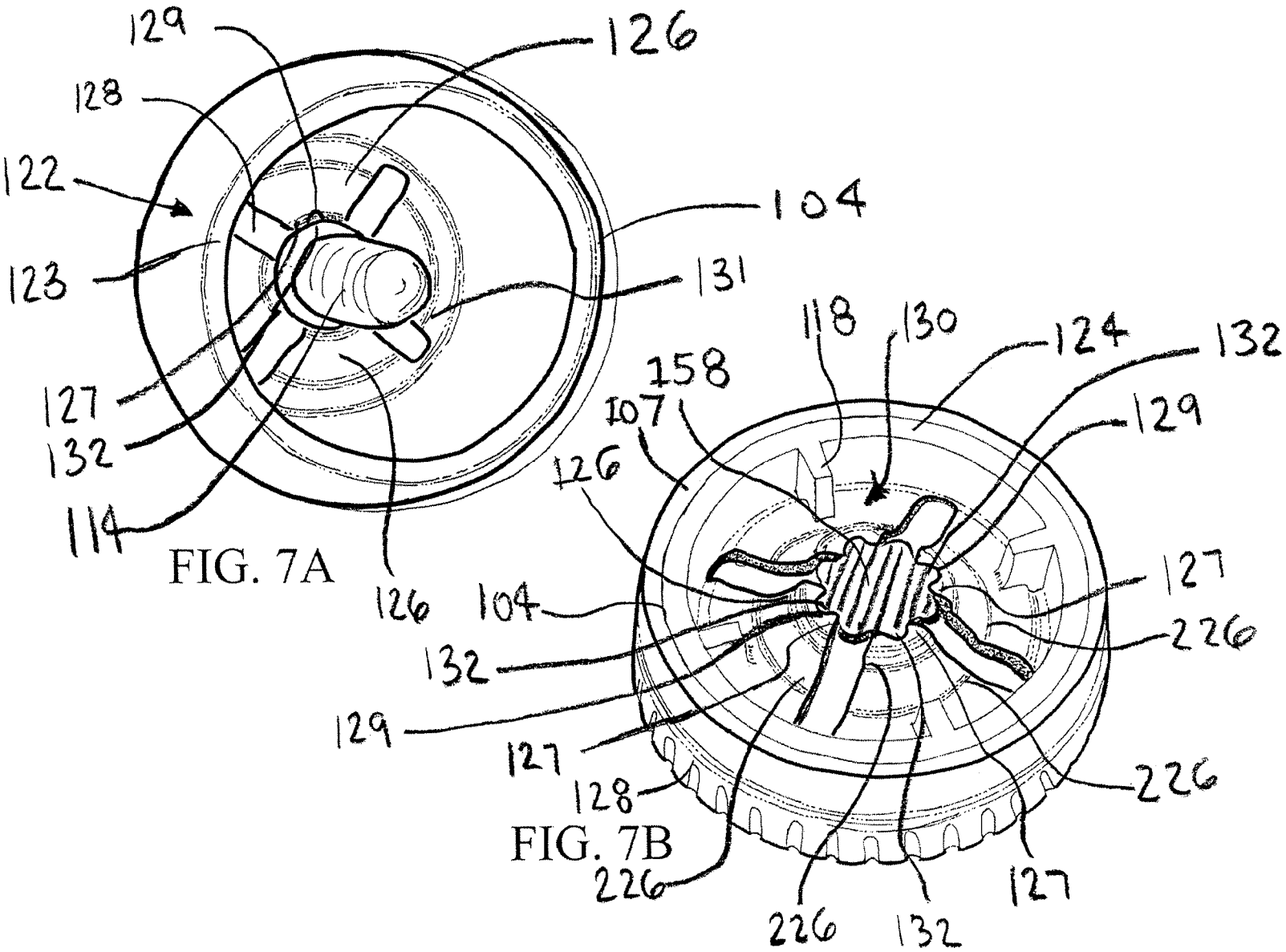
FIG. 7A is a top perspective view showing a component of a material applicator according to an embodiment of the invention.
FIG. 7B is a cross-sectional top perspective view of a component of a material applicator along line D-D of FIG. 2C according to an embodiment of the invention.

Referring to FIGS. 7A-7B, in assembly of a material applicator 100 according to embodiments, a actuator 136 of a material applicator 100 may be inserted into a casing 104 at its base portion 121 through an opening between distal portions 127 of cantilevered fingers 126 of the casing 104, into the cavity 111 of the casing 104. The base portion or actuating dial portion 128 of the actuator 136 is pushed against the base portion 121 of the casing 104. In embodiments, the base portion 128 of the actuator 136 may have the same approximate diameter as the base portion 121 of the casing 104.

FIG. 7B shows a cross-sectional top perspective view cut along line D-D in FIG. 2C showing a actuator 136 inserted into a casing 104. In embodiments, the distal portions 127 of the cantilevered fingers 126 of the casing 104 are urged against the camming portion 158 of the actuator 136 and the ribs 132 of the camming portion 158 may be seated in the seating portions 129 of the distal portions 127 of the cantilevered fingers 126. In embodiments, each cantilevered finger 126 is subjected to cantilevered bending so the distal portion of each cantilevered finger 126 is biased toward the outer surface 162. During rotation of the actuator 136, a cam action of each camming portion rib 132 may cause additional cantilevered bending in the cantilevered fingers 126, whereby a continued resistance to rotation is produced as the cam action of the ribs 132 causes the cantilevered fingers 126 to flex.

In embodiments, the material applicator 100 includes a resistance mechanism 130 providing resistance to rotation of the threaded drive spindle 114. In embodiments, the resistance mechanism 130 comprises a plurality of cantilevered fingers 126 supported by the casing 104 and a plurality of ribs 132 supported by the threaded drive spindle 114. In embodiments, each rib 132 extends radially outward beyond a outer surface 134 of the threaded drive spindle 114 and each rib extends upward and downward along the outer surface 134. In embodiments, each cantilevered finger 126 has a distal portion 127 selectively contacting the outer surface 134 and each cantilevered finger 126 is subjected to cantilevered bending so the distal portion of each cantilevered finger 126 is biased toward the outer surface 134. In embodiments, a cam action of each rib 132 causes additional cantilevered bending in the cantilevered fingers 126, whereby resistance to rotation is produced as the cam action of the ribs 132 causes the cantilevered fingers 126 to flex. In embodiments, during rotation of the spindle 114, the ribs 132 slip in and out of seating portions 129 in the distal portions 127 of the cantilevered fingers 126, providing a stepped, tactile feedback to the user.

After the actuator 136 is inserted and seated, an elevator 108 may be lowered onto the spindle 114 to a lower position within the cavity 111 of the casing 104. The cavity may be filled with material 102 and the cap 112 may be secured to the upper end 122 of the casing 104.

Figure 11B:
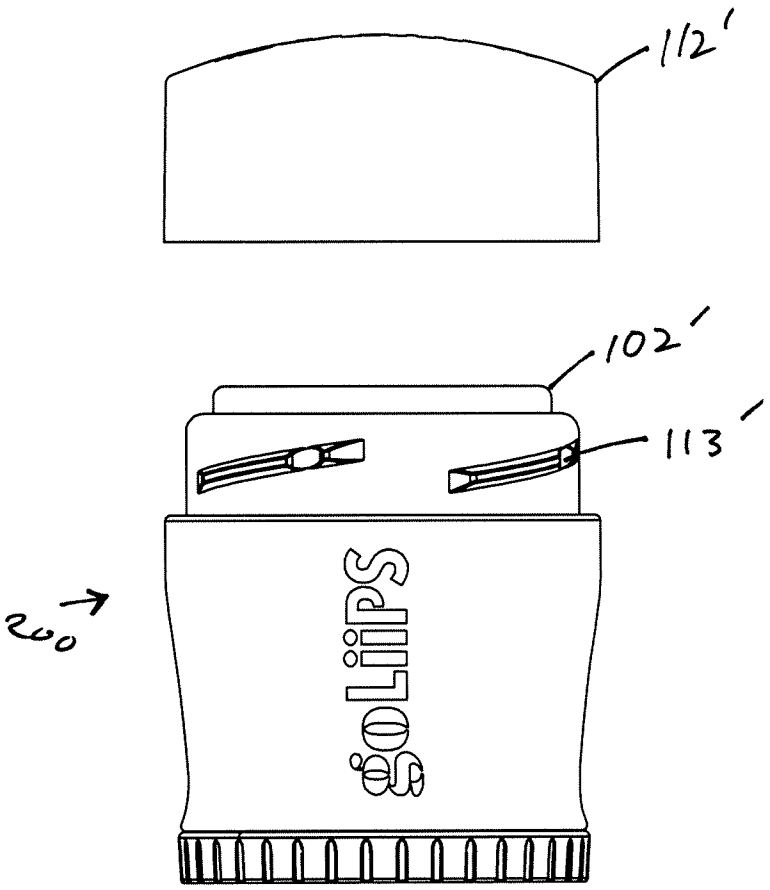
FIG. 11B is an elevational view of the embodiment of FIG. 11A with the cap removed.
Figure 11A:
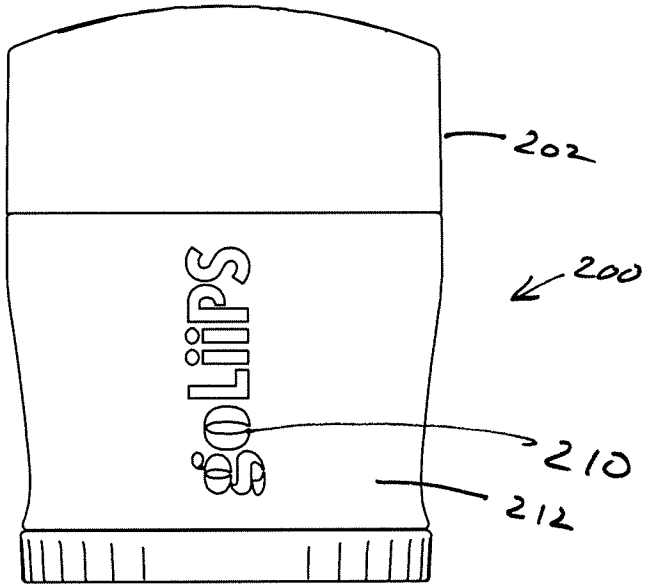
FIG. 11A is an elevational view of an embodiment.
Figure 12B:
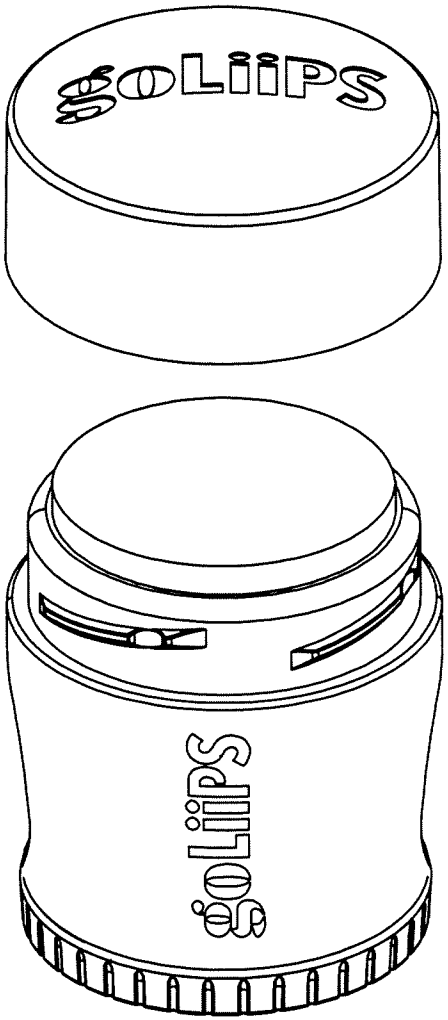
FIG. 12B is a perspective view of the embodiment of FIG. 12A with the cap removed.
Figure 12A:
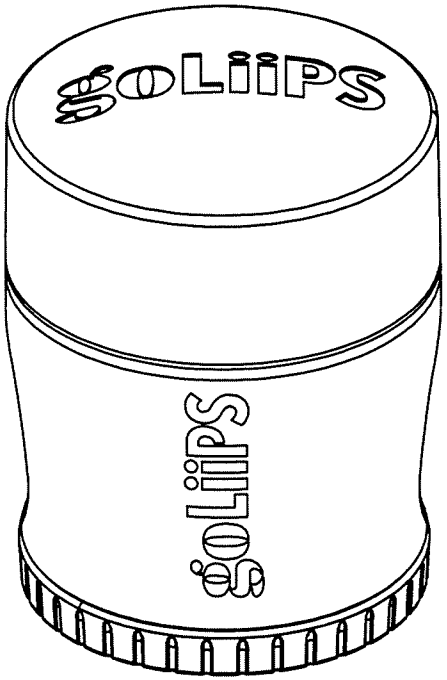
FIG. 12A is a perspective view of the embodiment of FIG. 11A.
Figure 13B:
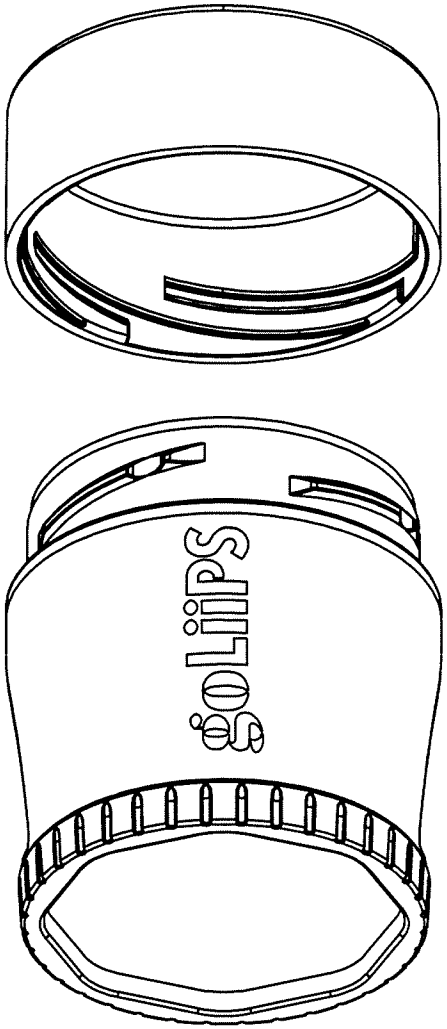
FIG. 13B is a perspective view of the embodiment of FIG. 13A with the cap removed.
Figure 13A:
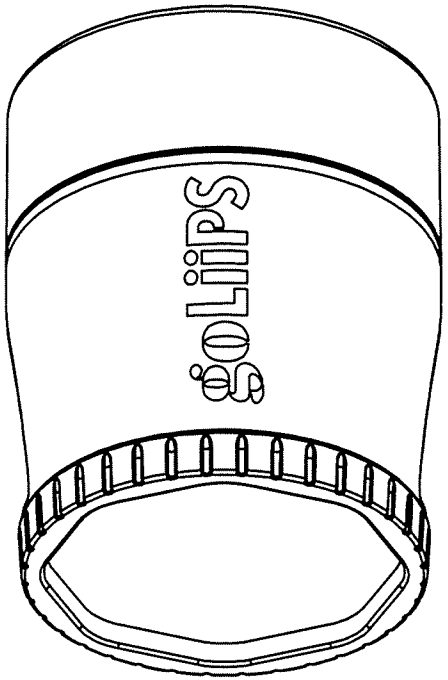
FIG. 13A is another perspective view of the embodiment of FIG. 10A.
Figure 14B:
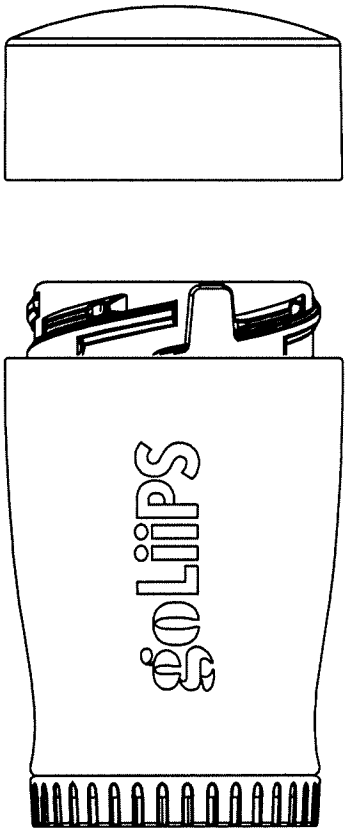
FIG. 14B is an elevational view of the embodiment of FIG. 14A with the cap removed.
Figure 14A:
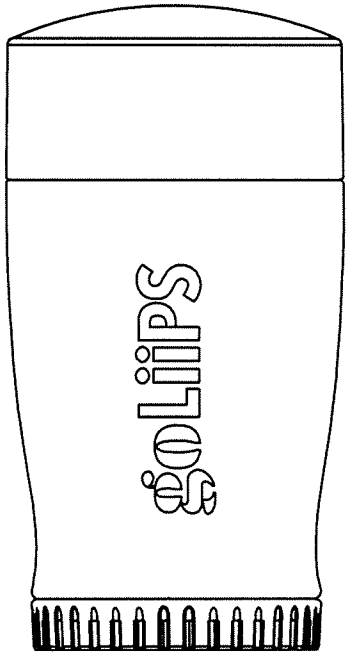
FIG. 14A is an elevational view of an embodiment.
Figure 15B:
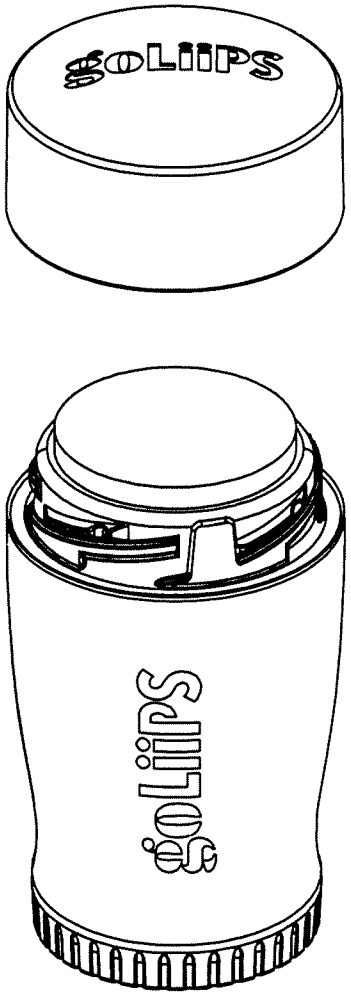
FIG. 15B is the embodiment of FIG. 15A with the cap removed.
Figure 15A:
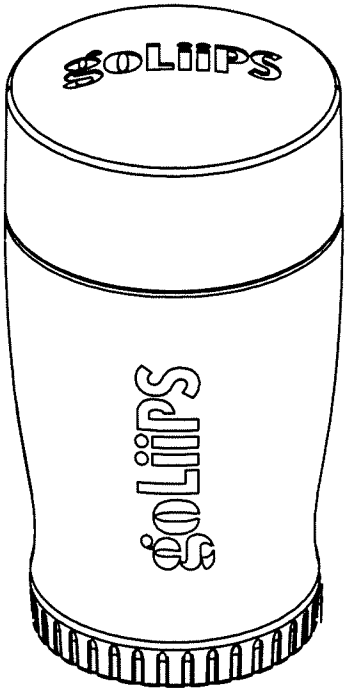
FIG. 15A is a perspective view of the embodiment of FIG. 14A.
Figure 16B:
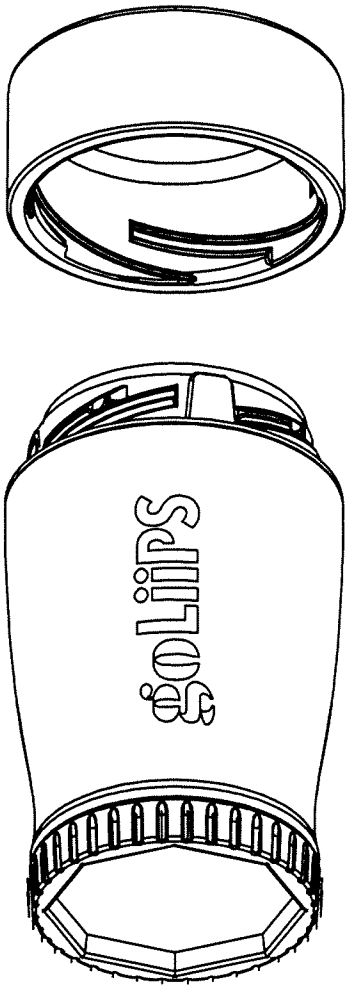
FIG. 16B is a perspective view of the embodiment of FIG. 14A with the cap removed.
Figure 16A:
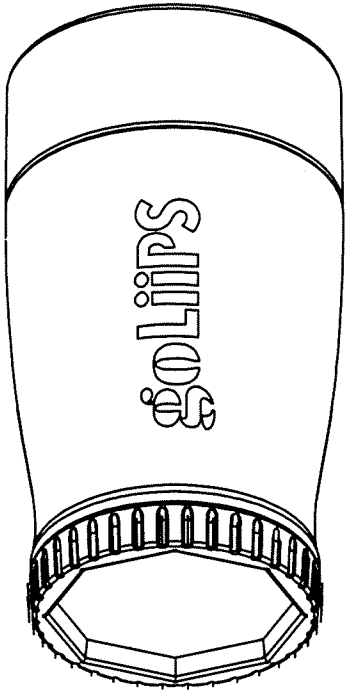
FIG. 16A is another perspective view of the embodiment of FIG. 14A.

Referring to FIGS. 8A-10B, a material applicator 100' may be provided for holding and dispensing or applying a material 102' to a target location. In embodiments, the material 102' may comprise a lip balm that is applied to the lips of a user. In embodiments, the material applicator 100' comprises a casing 104', a lid, cap or cover 112' and a dispense mechanism 106'. When the material applicator 100' is filled with the material 102', the dispense mechanism 106' may selectively move the material 102' upward and downward along a central axis 110' by rotating an actuating dial portion 128' of the dispense mechanism 106'. FIG. 11B shows an embodiment of the material applicator 100' with the lid 112' removed and the material 102' exposed. In embodiments, the lid 112' may be secured to the casing 104' via mating threading 113' of the lid 112' and the casing. The inner casing wall 124' may be molded with projecting portions 180' configured as indicia. The indicia projecting a distance equal to the thickness of a gripping layer 182' to be overmolded thereon resulting in the radial outer surfaces 184' being flush with the outer surface 186' of the gripping layer. The polymer of the inner casing wall may be light transmissive, that is, for example, transparent, or translucent. Polymers such as polypropylene and polycarbonate, amongst others, provide such a characteristic. This allows light to be transmitted from the casing to the exterior providing an aesthetically desirable appearance. Light can enter the inner casing wall through the lower end of the dispenser.

Figure 9A:
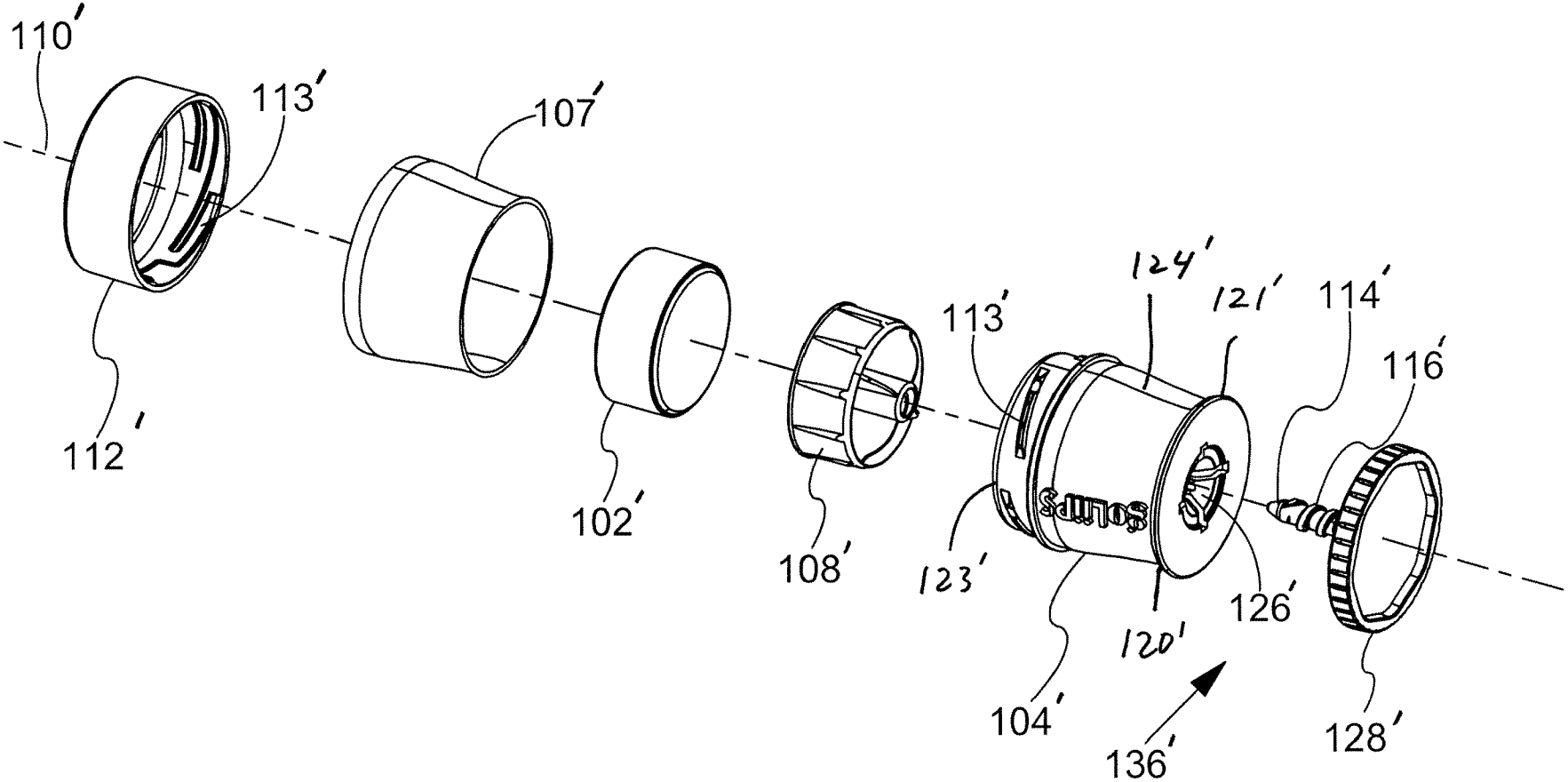
FIG. 9A is an exploded view of the material applicator of FIG. 8A.
Figure 9B:
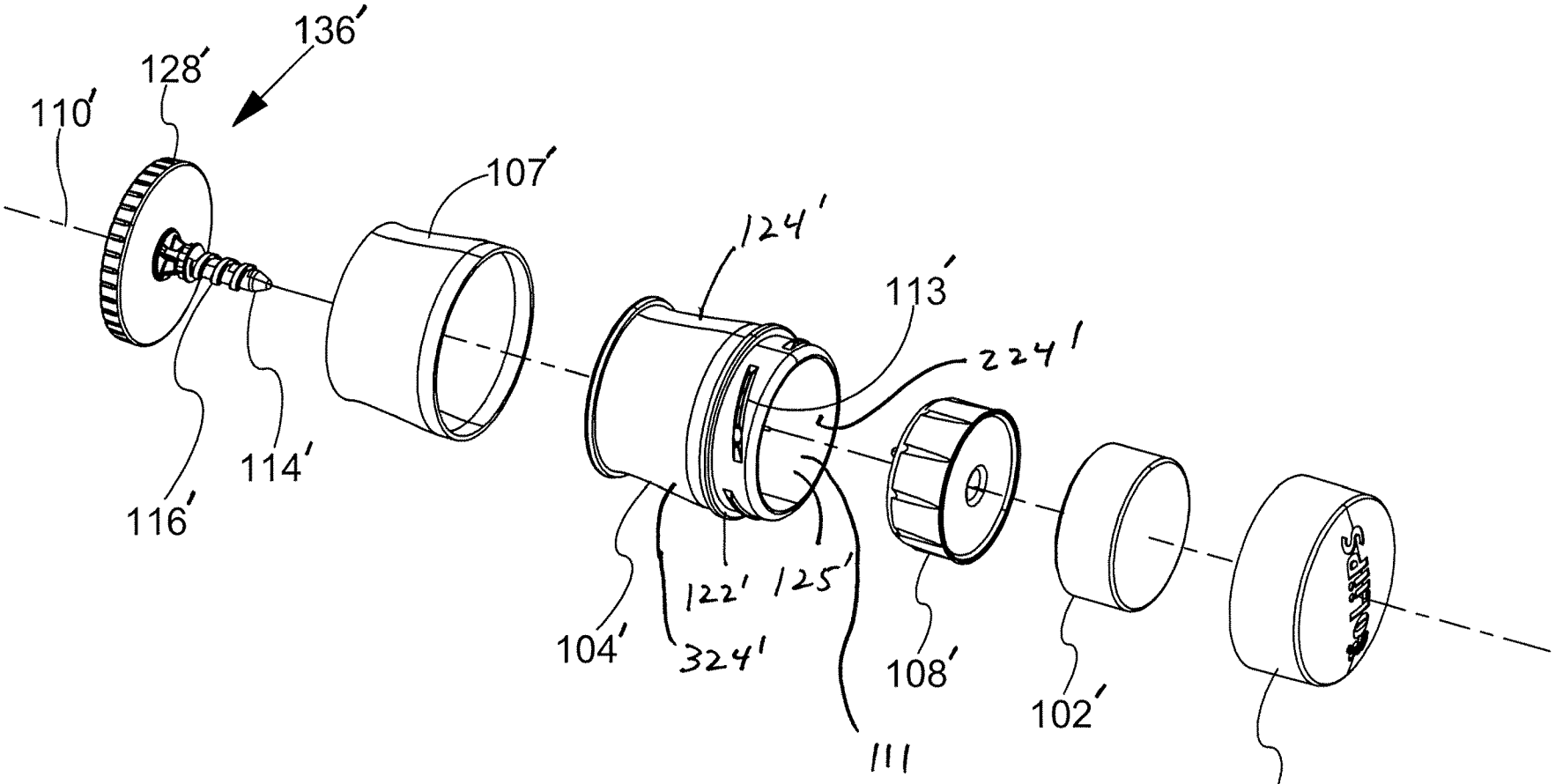
FIG. 9B is an exploded view, opposite from that of FIG. 9A.
Figure 10B:
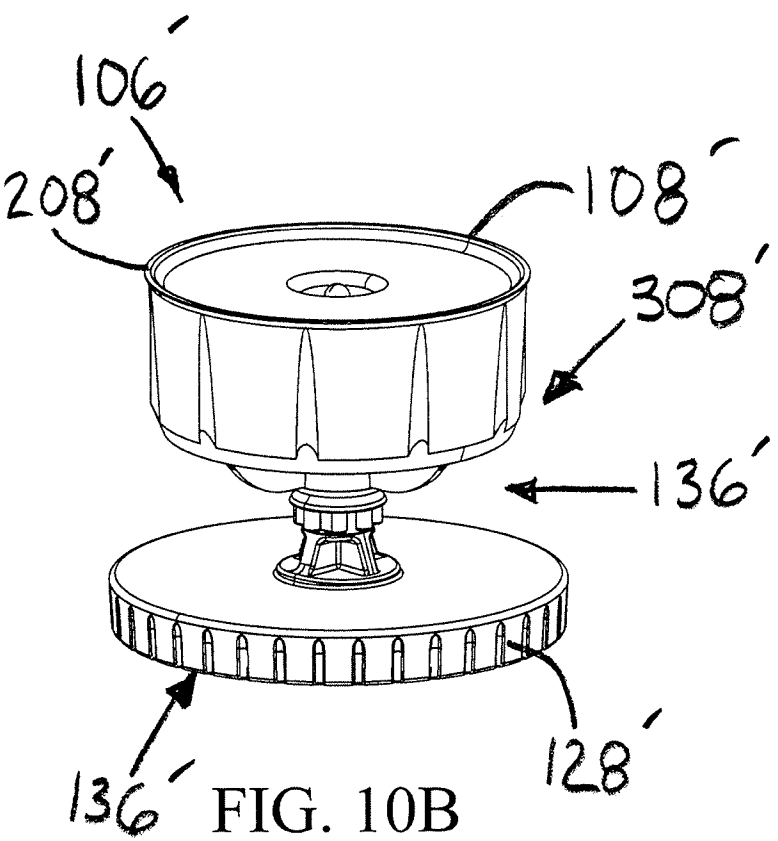
FIG. 10B is a perspective view of the elevator and actuator of FIG. 10A assembled.
Figure 10A:
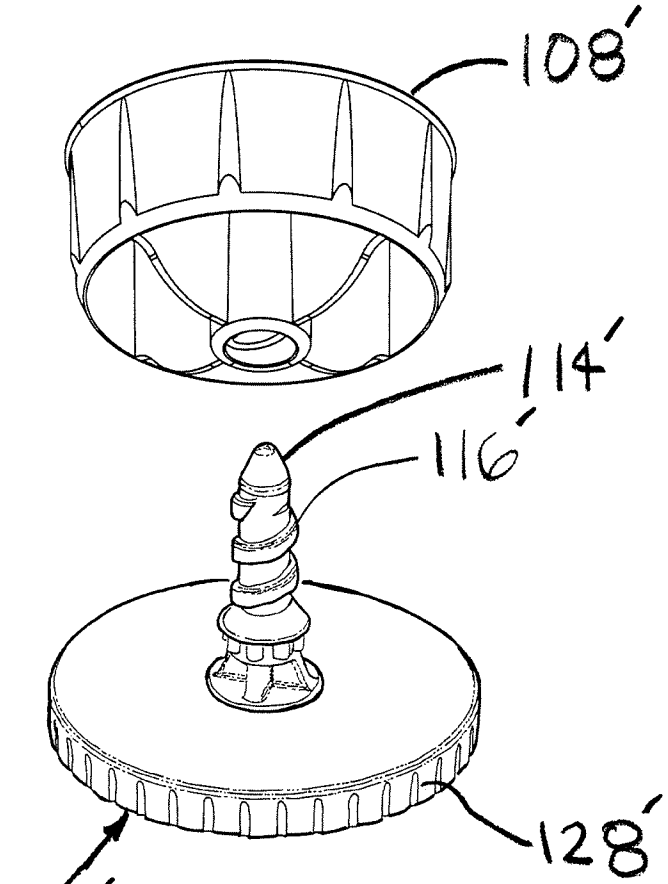
FIG. 10A is a perspective view of the elevator and actuator of the material applicator of FIG. 8A.

FIGS. 9A-9B show exploded views of the material applicator 100'. In embodiments, the casing 104' may comprise a base portion 121' at a lower end 120', a neck portion 123' and an opening or mouth 125' at an upper end 122' and a casing wall 124' therebetween. The neck portion 123' may comprise mating threading to engage the mating threading 113' of the cap 113'. In embodiments, the dispense mechanism 106' may comprise an elevator 108' and a actuator 136', which may comprise a spindle 114' having a thread 116' and an actuating dial portion or rotary wheel 128'. In embodiments, the thread 116' of the spindle 114' engages a thread engaging portion 115' of the elevator 108' so that the elevator 108' moves upward or downward along the thread 116' of the spindle 114', causing the material 102' to move upward or downward relative to the casing 104'.

Figure 8B:
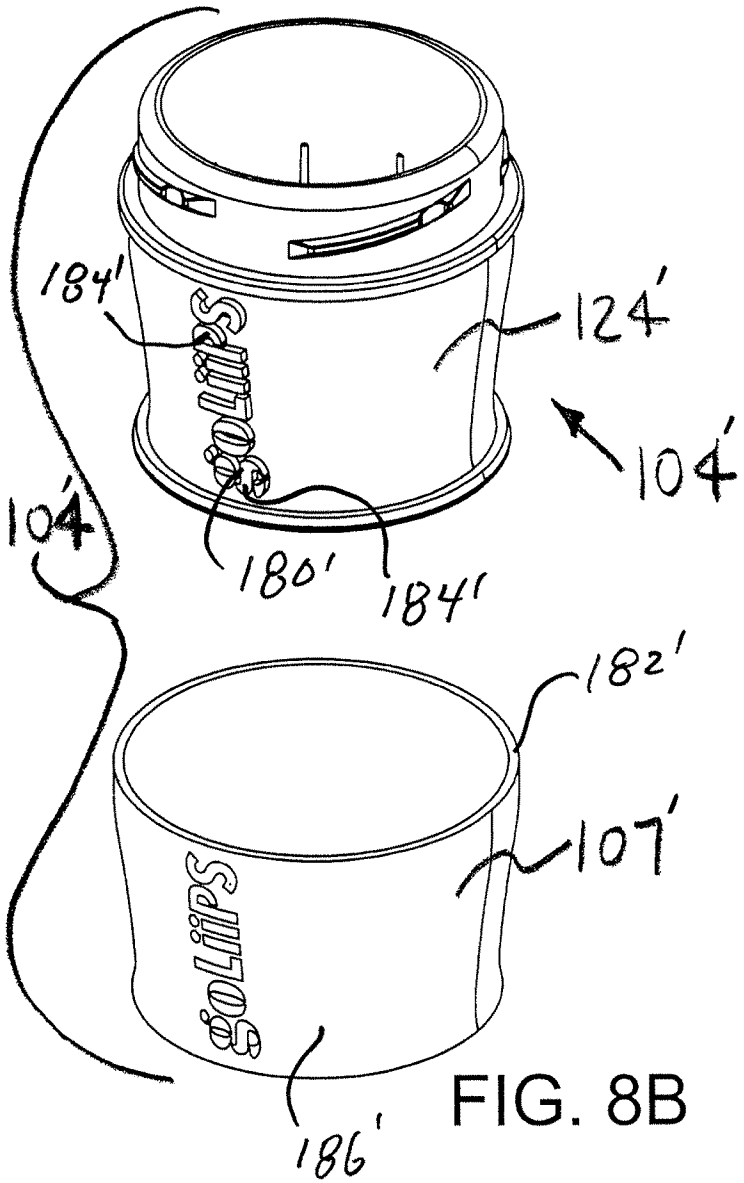
FIG. 8B is an exploded view of the embodiment of FIG. 8A.
Figure 8A:
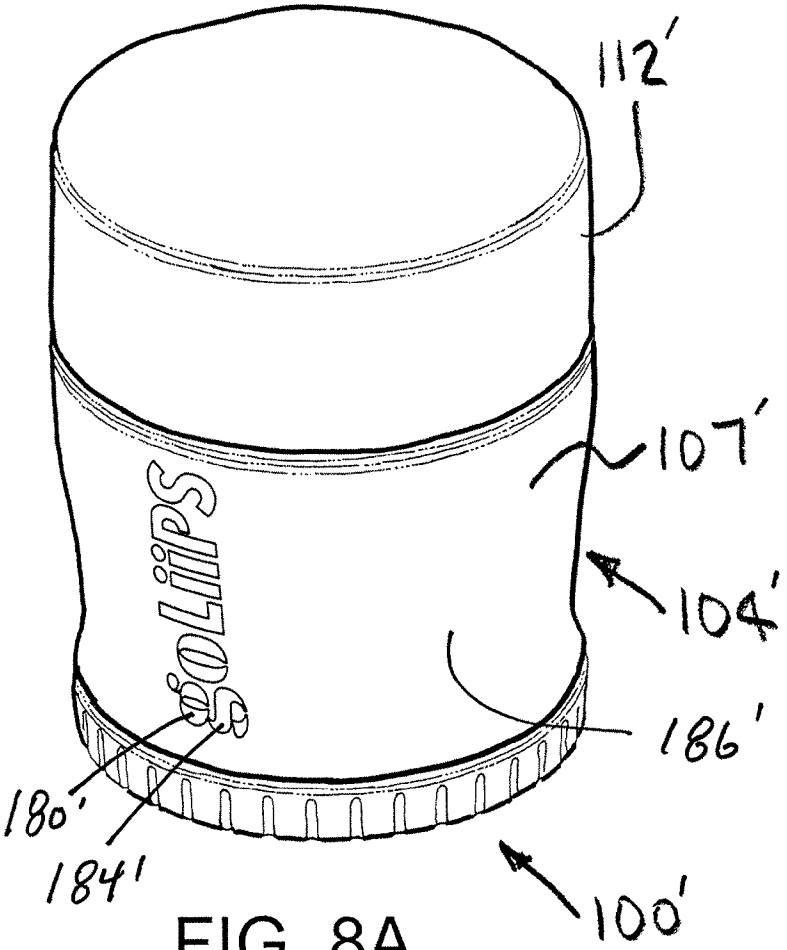
FIG. 8A is a perspective view of an embodiment of the invention.
Figure 8D:
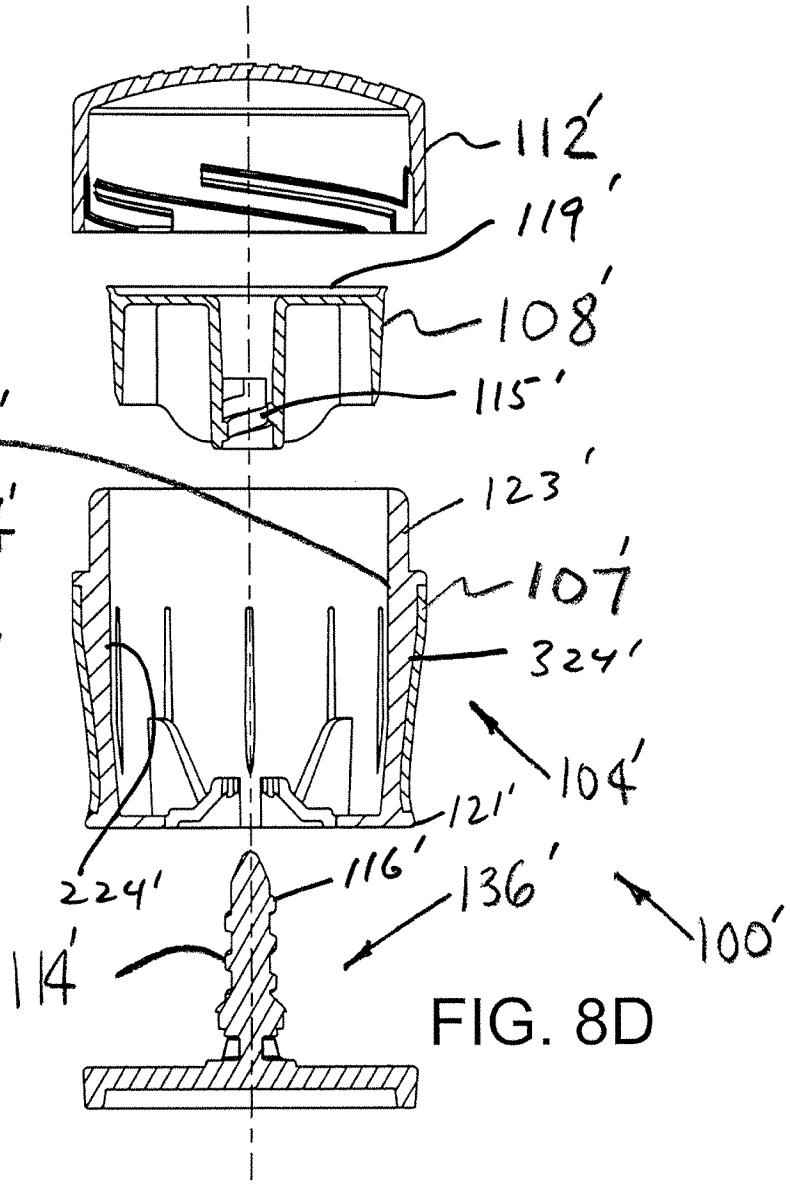
FIG. 8D is an exploded cross sectional view of the dispenser of FIG. 8C.
Figure 8C:
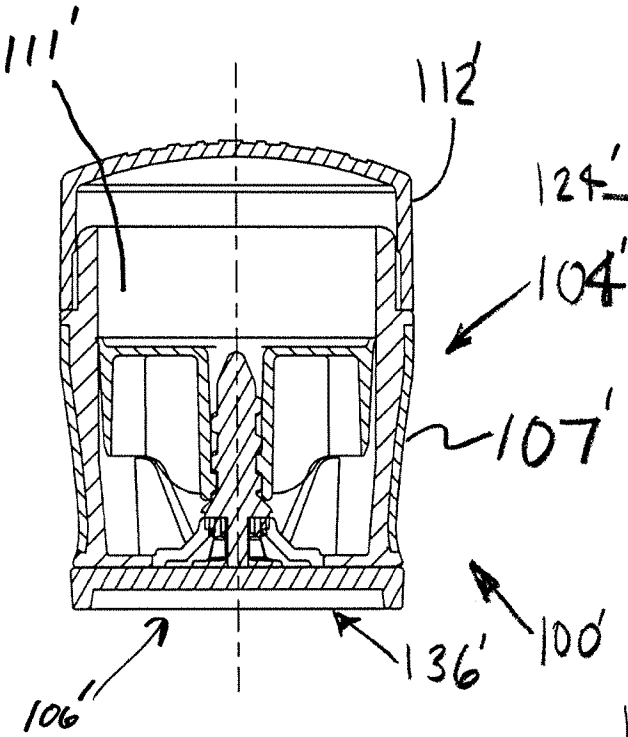
FIG. 8C is a cross sectional view of the embodiment of FIG. 8A.

Referring to FIGS. 8C and 8D, a cross-section view of a material applicator 100' in accordance with an example embodiment is shown. The material applicator 100' may have a cap 112 engaged with a neck portion 123' of casing 104' via mating threading 113'. The casing 104' may comprise a base portion 121' at a lower end 120', the neck portion 123' and an opening or mouth 125' at an upper end 122' and a casing wall 124' there between. The case wall 124' may comprise an inner surface 224' and an outer surface 324' and define a cavity 111'. A dispense or elevating mechanism 106' may be inserted through the base portion 121' and into the cavity 11'. The dispense mechanism 106' may comprise a thread engaging portion 115' of an elevator 108' engaged with thread 116' of a spindle 114' of an actuator 136'. In embodiments, the elevator 108' may be slidingly disposed inside the cavity 111' and the material 102' may be dispensed and held in an interface portion 119' of the elevator 108' and the cavity 111' above the elevator 108'.

FIGS. 11A-16B illustrate various designs of dispensers 200 with the caps 202 on and off and with indicia 210 exposed through outer gripping surfaces 212.

Figure 17B:
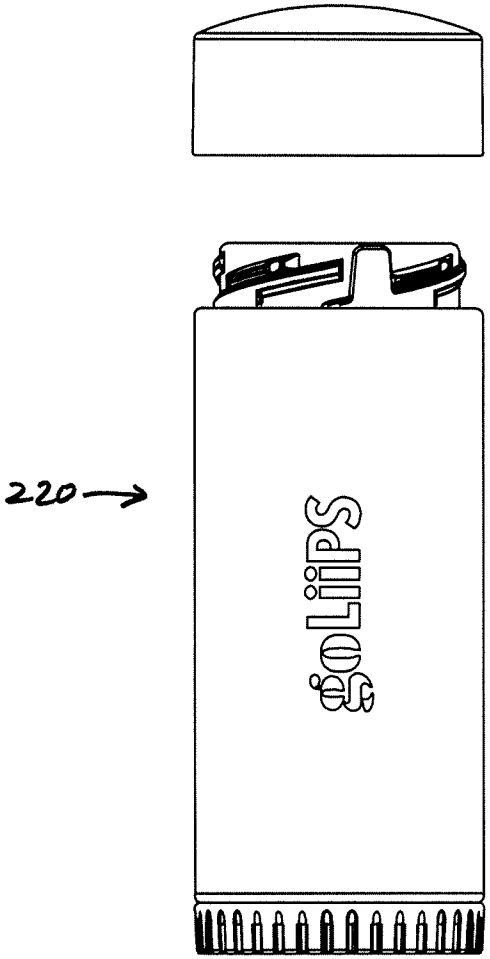
FIG. 17B is the embodiment of FIG. 17A with the cap removed.
Figure 17A:
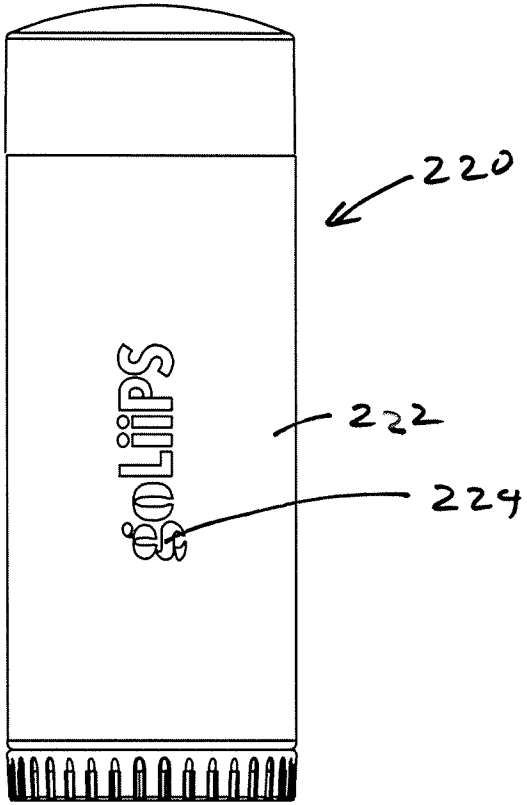
FIG. 17A is an elevational view of an embodiment.
Figure 18B:
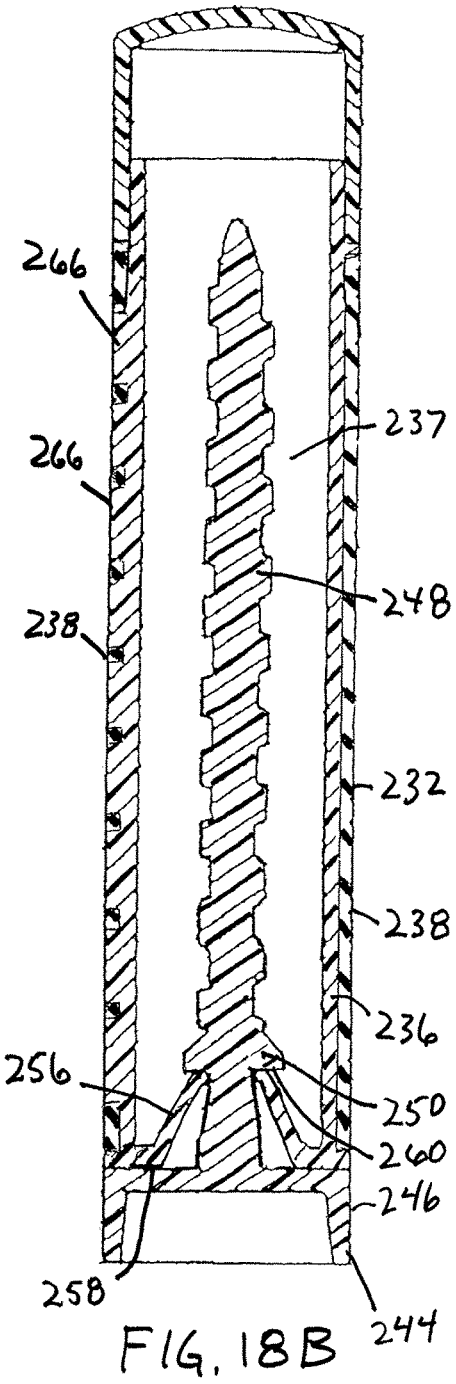
FIG. 18B is a cross sectional view of the embodiment of FIG. 18*A empty.*
Figure 18A:
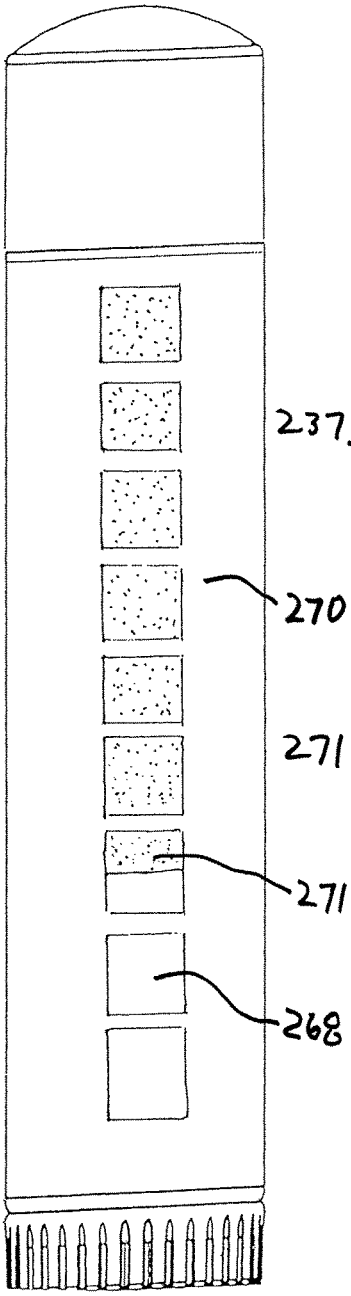
FIG. 18A is an elevational view of another embodiment.
Figure 18C:
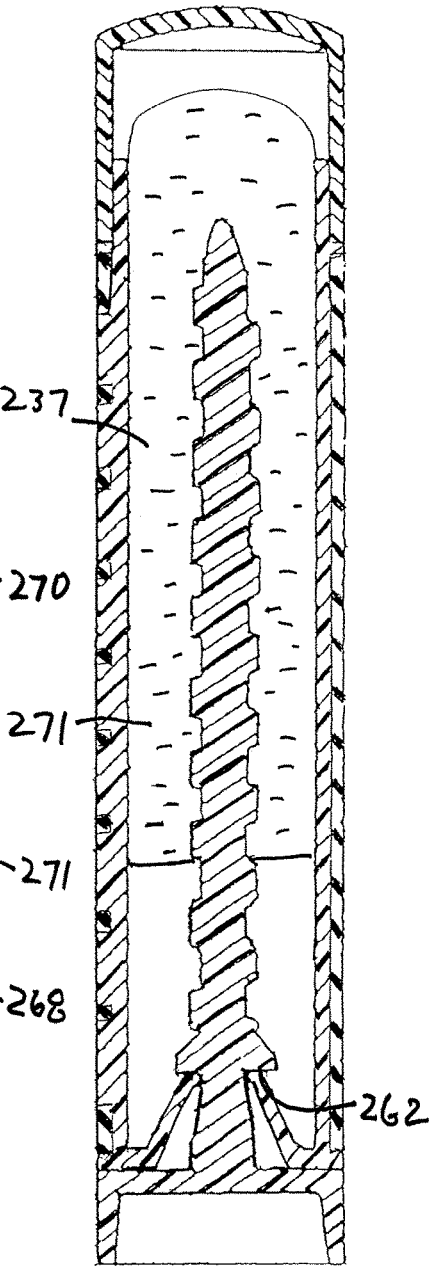
FIG. 18C is a cross sectional view of the embodiment of FIG. 18A showing the material level through the window.

FIGS. 17A and 17B illustrate dispensers 220 with a cylindrical casings 222 in accord with embodiments and indicia 224 formed by projecting portions from an inner casing wall, not shown in these views.

Referring FIGS. 17A-18C, a dispenser 230 has a cylindrical casing 232 with an inner casing wall 236 defining a cavity 237, an exterior layer 238, such as a gripping layer of thermoplastic elastomer overmolded on the inner casing wall, an actuator 244 with a dial 246 and a spindle 248 having a retention flange 250. Fingers 256 extend from the lower margin 258 of the inner casing wall 236 to capture the actuator 244 by engaging the lower side 260 and lower surface 262 of the retention flange 250. Projections 266 of the inner casing wall extend through the exterior layer providing windows 268 on the exterior surface 270 when the polymer of the inner casing wall is light transmissive. Such windows allow the user to view the material to be dispensed in the cavity such as illustrated in FIG. 18A, a clear indication of the amount of material in the cavity may be displayed, that is the material 271 is visible. In other embodiments, the elevator or markings on the elevator may be viewed to provide the user with information regarding the quantity of material in the respective dispenser.

Referring to the figures, an upward direction Z and a downward or lower direction −Z are illustrated using arrows labeled "Z" and "−Z," respectively. A forward direction Y and a rearward direction −Y are illustrated using arrows labeled "Y" and "−Y," respectively. A starboard direction X and a port direction −X are illustrated using arrows labeled "X" and "−X," respectively. The directions illustrated using these arrows are applicable to the apparatus shown and discussed throughout this application. The upward direction is generally the dispense end and opposite the downward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," should not be interpreted to limit the scope of the invention recited in the attached claims.

The term "portion" when used herein can mean all or part of a component, or an assembly. It may mean less than all of a unitary component, or all of a unitary component, or all of a component of an assembly of a plurality of components.

The following United States patents are hereby incorporated by reference herein: U.S. Pat. Nos. U.S. Pat. Nos. 9,795,205, 9,795,205, 9,585,460, 9,554,636, 9,554,636, 9,433,275, 9,433,275, 9,346,597, 9,339,097, 9,339,097, 9,327,891, 9,265,327, 9,265,327, 9,027,786, 8,899,860, 8,899,860, 8,708,146, 8,511,922, 8,407,879, 7,726,480, 7,621,405, 7,354,215, 7,354,215, 6,838,032, 6,736,267, 6,723,269, U.S. Pat. Nos. 6,688,793, 6,598,767, 6,598,767, 6,572,300, 6,572,300, 6,450,716, 6,419,412, 6,419,412, 6,398,439, U.S. Pat. Nos. 6,364,115, 6,305,385, 6,299,369, 6,299,369, 6,269,982, 6,050,415, 5,899,333, 4,958,731 and 4,784,268; and U.S. Pat. Publication Nos. US20180086542, US20180086542, US20180086541, US20180086541, US20180207413, US20160174686 and US20160174685. The above references to U.S. patents in all sections of this application are herein incorporated by references in their entirety for all purposes. Components illustrated in such patents may be utilized with embodiments herein. Incorporation by reference is discussed, for example, in MPEP section 2163.07(B).

The above references in all sections of this application are herein incorporated by references in their entirety for all purposes. All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A dispenser of material for application to lips, the dispenser comprising:

a casing having a lower end and an upper end, the casing having a casing wall defining a cavity with an axis;

an elevator slidingly engaged with the casing wall in the cavity, a stick of material for application to lips being disposed on the elevator and in the cavity;

an actuator rotatably secured to the casing, the actuator having a screw portion threadably engaged with the elevator and a dial positioned at the lower end of the casing, whereby rotation of the dial moves the elevator axially;

wherein the casing wall is an inner casing wall and an outer overmolded wall portion extends therearound, the inner casing wall comprising a first thermoplastic material and the outer overmolded portion comprising a second thermoplastic material different from the first thermoplastic material, the inner wall including an indicia portion projecting radially outward through the outer overmolded wall portion whereby indicia is outwardly exposed on the casing.

2. The dispenser of claim 1, wherein the inner casing wall is formed of a light transmissive polymer and the radial projection portion is unitary with the inner casing wall and is formed of the light transmissive polymer.

3. A dispenser for holding a material while the material is applied to a target location, the material applicator comprising:

a casing having a lower end, an upper end, and a casing wall extending upward from the lower end to the upper end, the casing wall defining a cavity extending along a central axis, the casing wall extending in an arcuate path around the central axis and the cavity, the casing wall supporting a plurality of cantilevered fingers proximate the lower end, each cantilevered finger extending inwardly from the casing wall toward the central axis and upwardly from the lower end of the casing wall;

a dispense mechanism comprising an elevator slidingly disposed inside the cavity defined by the casing wall, the material being located in the cavity above the elevator, wherein the dispense mechanism selectively moves the elevator upward and downward along the central axis, the dispense mechanism further comprising a spindle having a thread, the thread engaging the elevator, the spindle extending upward into the cavity from a base;

wherein the elevator translates upward when the base portion is rotated in a first direction and the elevator translates downward when the base portion is rotated in a second direction;

a resistance mechanism providing resistance to rotation of the spindle, the resistance mechanism comprising the cantilevered fingers supported by the casing and a plurality of ribs supported by the spindle, each rib extending radially outward beyond a outer surface of the spindle, each rib extending upward and downward along the outer surface, each cantilevered finger having a distal portion selectively contacting the outer surface, each cantilevered finger being subjected to cantilevered bending so the distal portion of each cantilevered finger is biased toward the outer surface;

wherein a cam action of each rib causes additional cantilevered bending in the cantilevered fingers whereby resistance to rotation is produced as the cam action of the ribs causes the cantilevered fingers to flex.

4. The material applicator of claim 3, wherein the ribs are equally spaced along a path extending along a circumference of the cylinder.

5. The material applicator of claim 3, wherein the ribs being spaced apart by a predetermined arcuate distance, the predetermined arcuate distance extending between each pair of adjacent ribs.

6. The material applicator of claim 3, wherein the casing comprises a base portion and an overmold portion, the base portion comprising a first thermoplastic material and the overmold portion comprising a second thermoplastic material different from the first thermoplastic material, the first thermoplastic material being more rigid than the second thermoplastic material, the base portion having a base surface and the overmold portion having a overmold surface, the base surface being smoother than the overmold surface.

7. The material applicator of claim 3, wherein the material forms a stick.

8. The material applicator of claim 3, wherein the material is one of a lip balm, a deodorant, a sunscreen, an insect repellant, a shoe polish, a lipstick and a glue stick.

9. The material applicator of claim 3, wherein the casing is substantially circular in cross-section along a cross-section plane, the cross-section plane being orthogonal to the central axis.

10. The material applicator of claim 3, wherein the base portion has a base aspect ratio of base diameter to base height that is greater than eight.

11. The material applicator of claim 3, wherein the shaft portion has a shaft aspect ratio of shaft height to shaft outer diameter that is greater than eight.

12. The material applicator of claim 3, wherein each of the cantilevered fingers comprises two tip portions, each arm defining a distal groove, the distal groove being located between the two tip portions.

13. A dispenser of material comprising:

a casing having a lower end and an upper end, the casing having an inner casing wall defining a cavity with an axis;

a stick of material for application being disposed in the cavity;

an actuator rotatably secured to the casing, the actuator having a screw portion extending upwardly into the casing cavity and into the stick of material and a dial positioned at the lower end of the casing;

wherein the casing has an outer overmolded wall portion extending around the inner casing wall, the inner casing wall comprising a first thermoplastic material and the outer overmolded portion comprising a second thermoplastic material different from the first thermoplastic material, the inner wall including a portion projecting radially outward through the outer overmolded wall portion whereby the portion is outwardly exposed on the casing.

14. The dispenser of claim 13, wherein the radial projection portion is configured as indicia including at least one letter of the alphabet.

15. The dispenser of claim 13, wherein the inner casing wall is formed of a light transmissive polymer and the radial projection portion is unitary with the inner casing wall and is formed of the same material.

16. The dispenser of claim 15, wherein the radial projection portion provides a viewing window into the casing.

17. The dispenser of claim 16, wherein the viewing window allows a user to see the amount of dispensing material remaining in the dispenser.

18. The material applicator of claim 17, wherein the material is one of a lip balm, a deodorant, a sunscreen, an insect repellant, a shoe polish, a lipstick and a glue stick.

19. The material applicator of claim 18, wherein the casing is substantially circular in cross-section along a cross-section plane, the cross-section plane being orthogonal to the central axis.

20. The material applicator of claim 13, further comprising a plurality of upwardly and inwardly extending fingers circularly spaced and extending from the lower portion of the casing, the plurality of fingers engaging a retention flange on the actuator.

21. The material applicator of claim 20, wherein each of the cantilevered fingers comprises a cam portion that engages a plurality of nubs or ribs spaced about the actuator shaft such that rotation of the actuator deflect or compresses each cantilevered finger as the finger engages each of the plurality of nubs or ribs.

* * * * *